United States Patent [19]

Smith

[11] Patent Number: 5,046,944

[45] Date of Patent: Sep. 10, 1991

[54] INFRA-RED GENERATION

[76] Inventor: Thomas M. Smith, 1415 Golf Rd., Cinnaminson, N.J.

[21] Appl. No.: 329,551

[22] Filed: Mar. 28, 1989

Related U.S. Application Data

[60] Division of Ser. No. 12,732, Feb. 9, 1987, abandoned, and a continuation-in-part of Ser. No. 771,722, Sep. 3, 1985, and a continuation-in-part of Ser. No. 831,795, Feb. 19, 1986, Pat. No. 4,722,681, and a continuation-in-part of Ser. No. 592,793, Mar. 23, 1984, Pat. No. 4,654,000.

[51] Int. Cl.[5] ..... F24D 14/12

[52] U.S. Cl. ..... 431/328; 431/326

[58] Field of Search ..... 34/155, 156, 79, 86; 432/72, 223, 58; 431/326, 327, 328, 298

[56] References Cited

U.S. PATENT DOCUMENTS

| | | | |
|---|---|---|---|
| 3,114,410 | 12/1963 | Schneider | 431/328 X |
| 3,552,378 | 1/1971 | Zavadsky | 431/328 X |
| 3,793,741 | 2/1974 | Smith, Jr. | 34/68 X |
| 3,824,064 | 7/1974 | Bratko | 431/328 |
| 4,475,294 | 10/1984 | Henricks | 34/155 X |

*Primary Examiner*—Henry A. Bennet

*Attorney, Agent, or Firm*—Connolly and Hutz

[57] ABSTRACT

Gas-fired burner having porous ceramic face through which gaseous combustion mixture emerges and on the emerging surface of which the mixture burns, can heat substrate with help of streams of air or recycled combusted gas sweeping across substrate to help remove moisture or other volatiles being driven from substrate. Burner body can have pilot ignition compartment. Ceramic face can be large ceramic fiber mat the back of which is supported to burner body back. Combustion mixture can be controlled to essentially stoichiometric.

6 Claims, 17 Drawing Sheets

FIG. 1
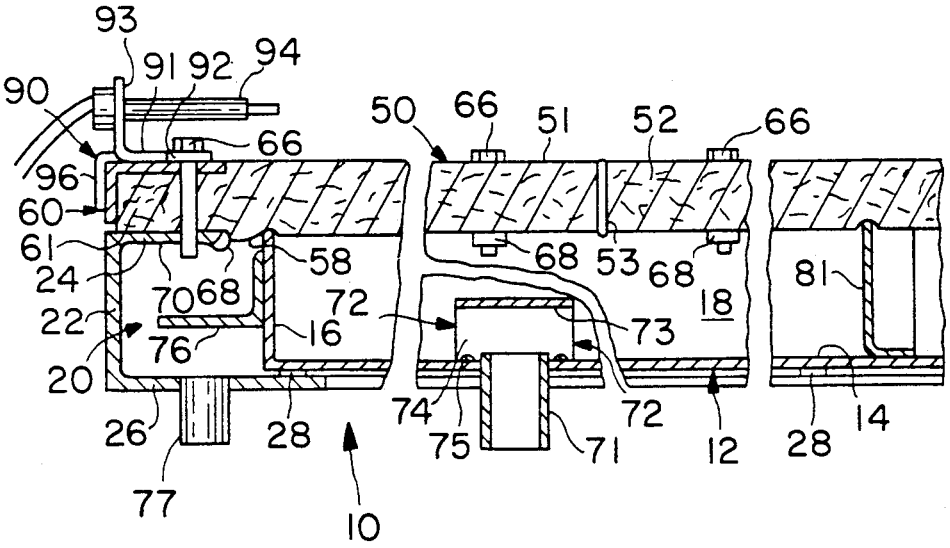
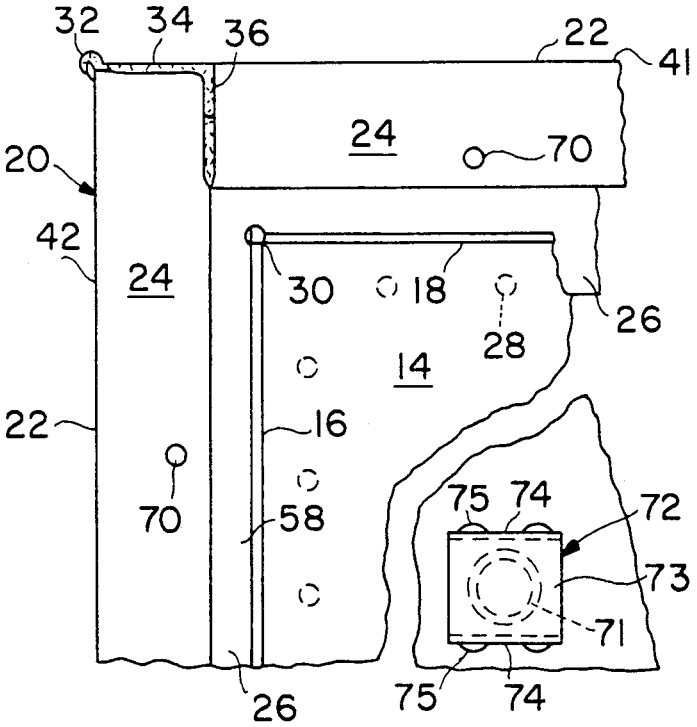
FIG. 2

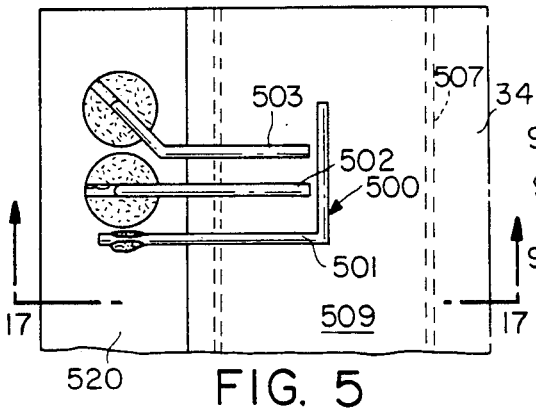
FIG. 5
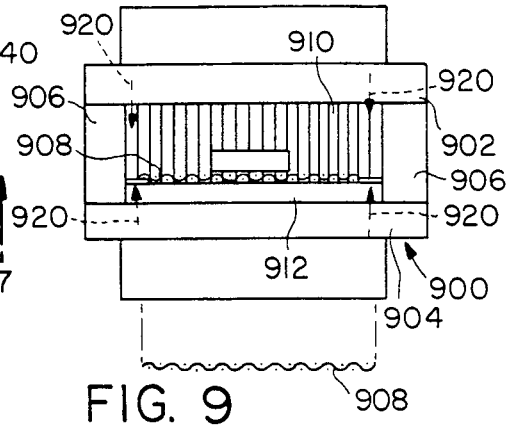
FIG. 9
FIG. 6
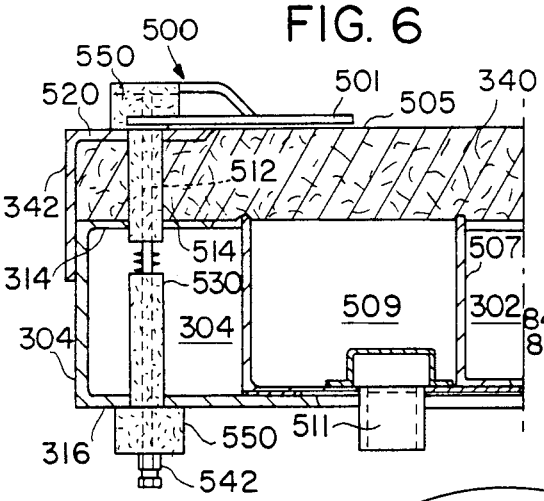
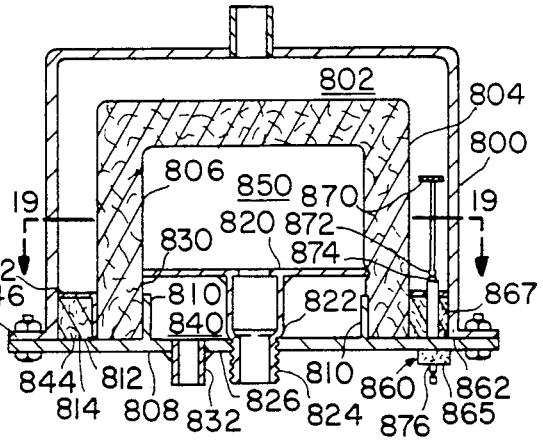
FIG. 7
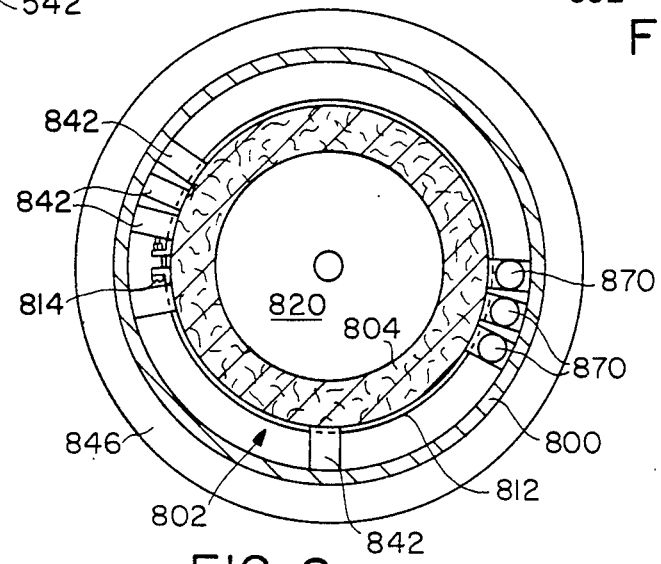
FIG. 8

FIG. 10
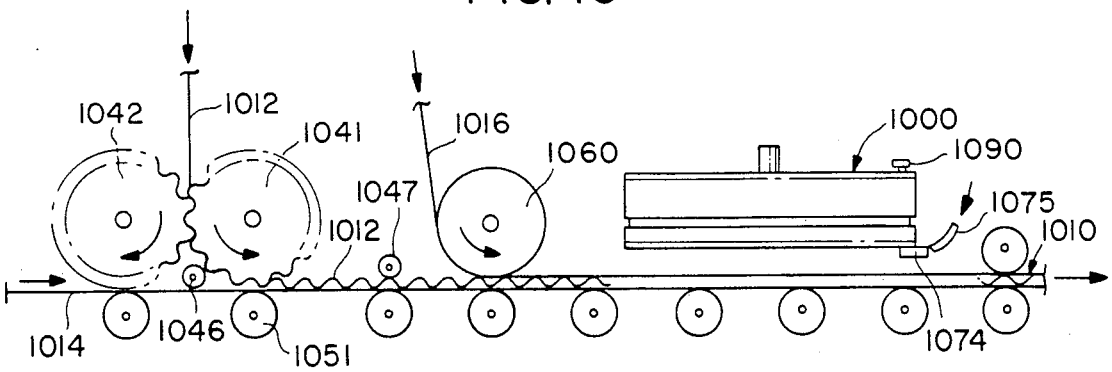
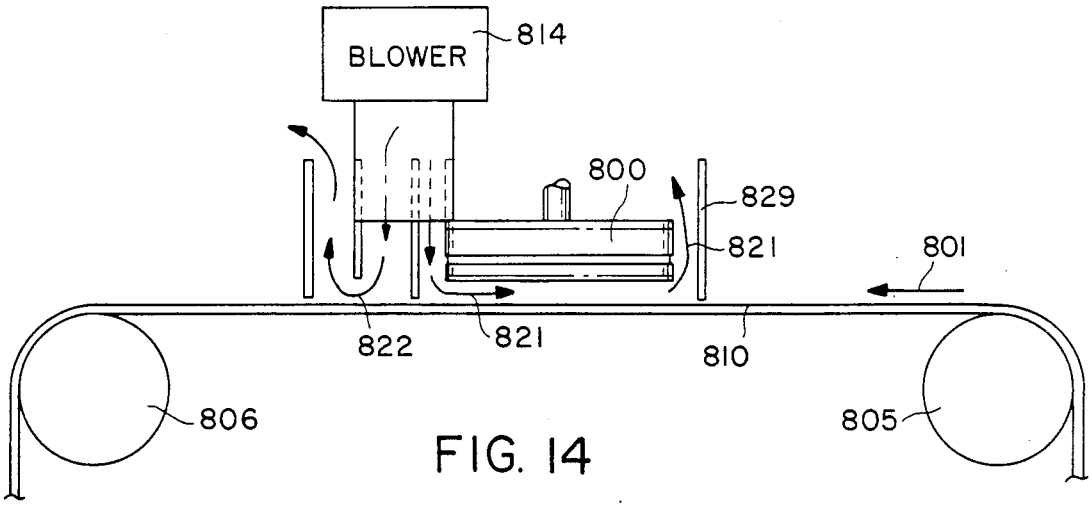
FIG. 14

FIG. 12
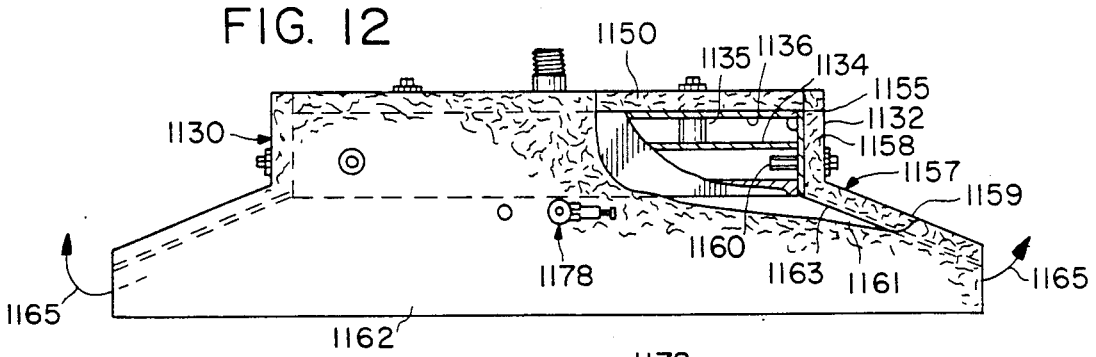
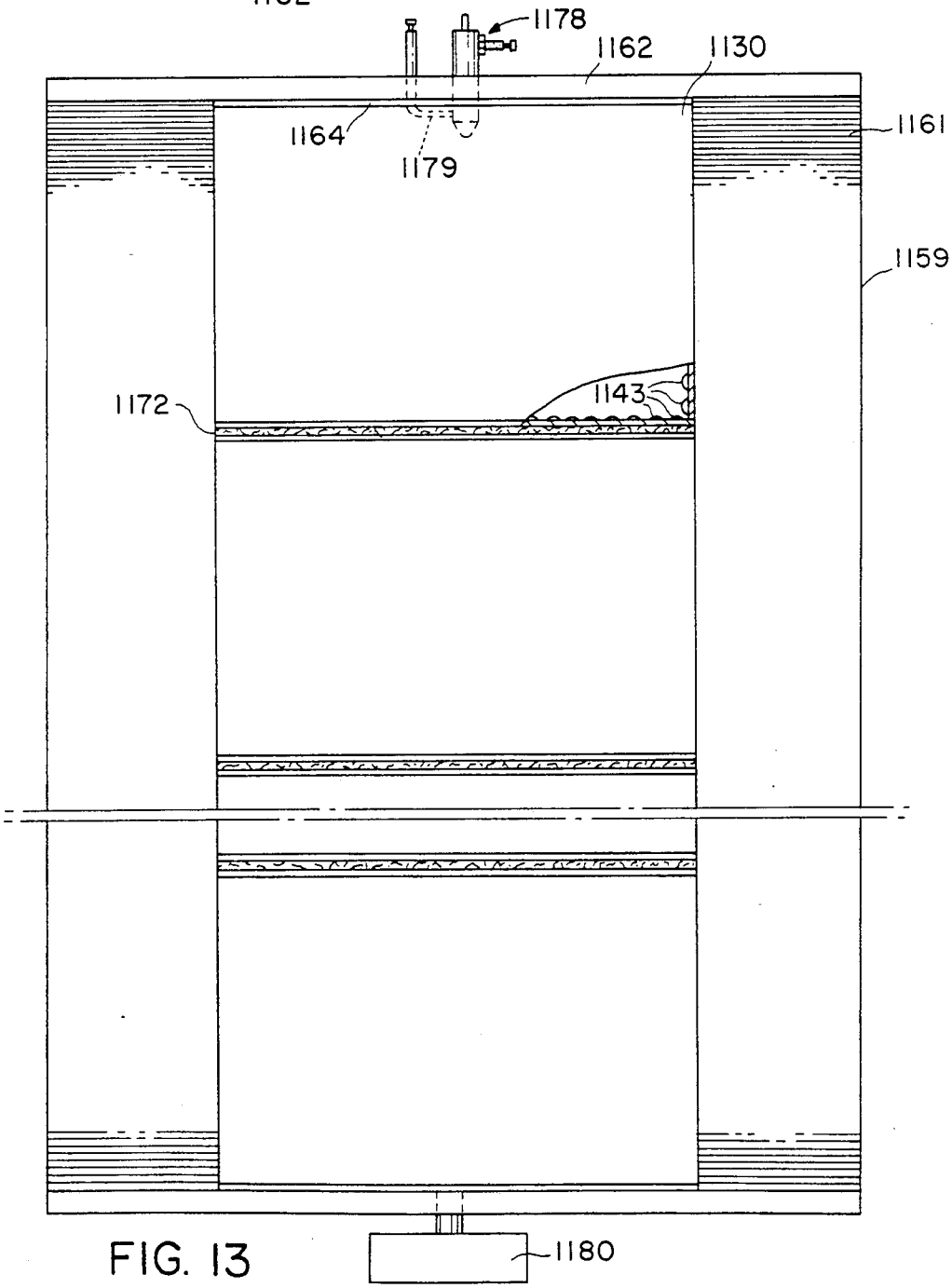
FIG. 13

INFRA-RED GENERATION

This application is a division of application Ser. No. 12,732 filed Feb. 9, 1987 now abandoned, and a continuation-in-part of application Ser. No. 771,222 filed Sept. 3, 1985. Those earlier applications are in turn direct or chained continuations-in-part of the following still earlier applications:

| Ser. No. | Filing Date | Status |
|---|---|---|
| 831,795 | Feb. 19, 1986 | Patent 4,722,681 granted Feb. 2, 1988 |
| 752,908 | Jul. 8, 1985 | Patent 4,604,054 granted Aug. 5, 1986 |
| 628,989 | Jul. 9, 1984 | Patent 4,589,843 granted May 20, 1986 |
| 592,793 | Mar. 23, 1984 | Patent 4,654,000 granted Mar. 31, 1987 |
| 567,270 | Dec. 30, 1983 | Abandoned |
| 509,161 | June 29, 1983 | Patent 4,500,283 granted Feb. 19, 1985 |
| 435,412 | Oct. 20, 1982 | Abandoned |
| 312,730 | Oct. 19, 1981 | Patent 4,443,185 granted Apr. 17, 1984 |
| 292,167 | Aug. 12, 1981 | Patent 4,474,552 granted Oct. 2, 1984 |
| 279,081 | June 30, 1981 | Patent 4,416,618 granted Nov. 22, 1983 |
| 238,418 | Feb. 26, 1981 | Patent 4,447,205 granted May 8, 1984 |
| 186,491 | Sep. 12, 1980 | Patent 4,378,207 granted Mar. 29, 1983 |
| 178,121 | Aug. 14, 1980 | Patent 4,373,904 granted Feb. 15, 1983 |
| 94,901 | Nov. 16, 1979 | Patent 4,272,238 granted Jun. 9, 1981 |
| 20,079 | Mar. 13, 1979 | Patent 4,290,746 granted Sept. 22, 1981 |
| 952,332 | Oct. 18, 1978 | Patent 4,326,843 granted Apr. 27, 1982 |
| 906,229 | May 15, 1978 | Patent 4,157,155 granted Jun. 5, 1979 |
| 863,251 | Dec. 22, 1977 | Patent 4,224,018 granted Sep. 23, 1980 |
| 775,838 | Mar. 9, 1977 | Patent 4,272,237 granted Jun. 9, 1981 |

The present invention is related to apparatus for generating infra-red radiation, and the manufacture and use of such apparatus.

Among the objects of the present invention is the provision of improved apparatus for generating and using infra-red radiation.

Additional objects of the present invention include the provision of novel packaging arrangements for such apparatus.

The foregoing as well as additional objects of the present invention will be clear from the following description of several of its exemplifications, reference being made to the accompanying drawings wherein:

FIG. 1 is a sectional view of one form of infra-red generator or burner according to the present invention;

FIG. 2 is a plan view of a corner detail of the burner of FIG. 1, with the upper members removed;

FIG. 5 is broken-away plan view of a portion of a heater showing a detail feature suitable for use according to the present invention;

FIG. 6 is a sectional view of the construction of FIG. 5, taken along line 6—6;

FIG. 7 is a sectional view of a novel heat exchanger incorporating a ceramic fiber heater and illustrative of the present invention;

FIG. 8 is a sectional view of the burner of FIG. 7, taken along line 8—8;

FIG. 9 illustrates an enclosed burner construction of the present invention;

Figure 11:
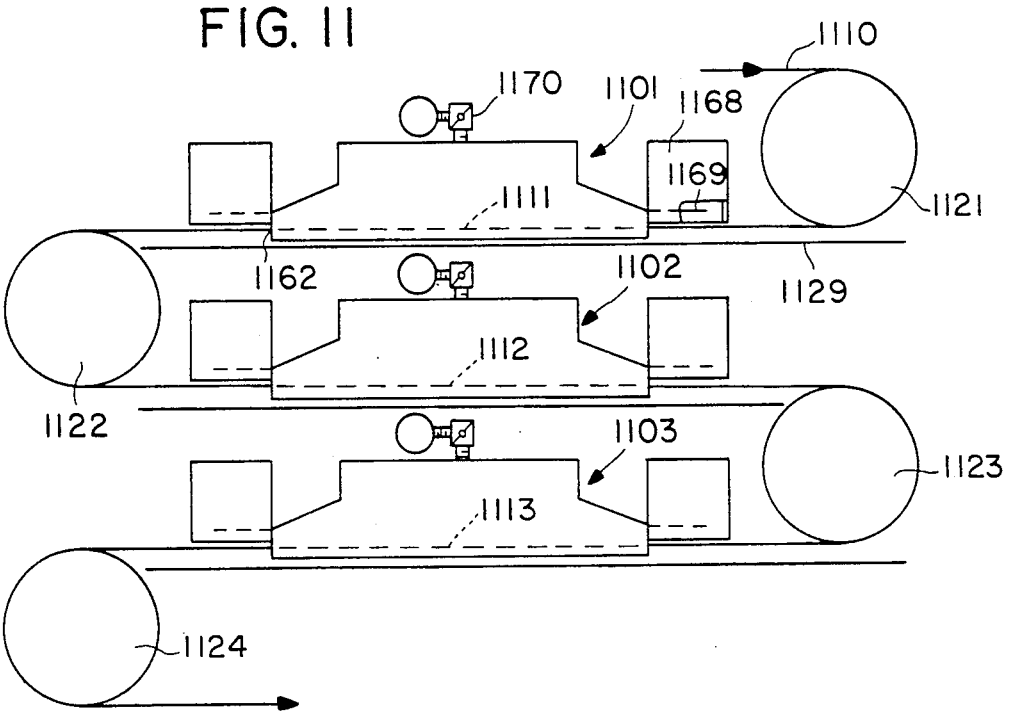
Figure 22:
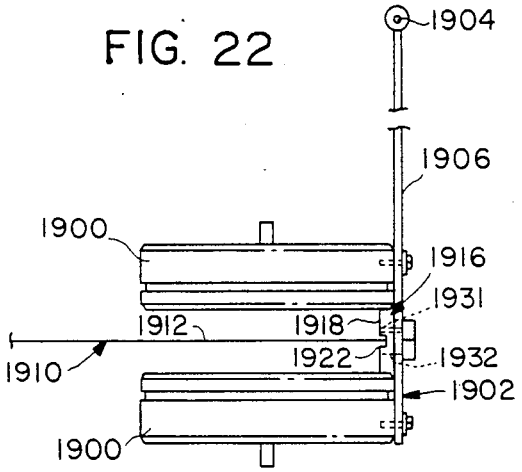
Figure 18:
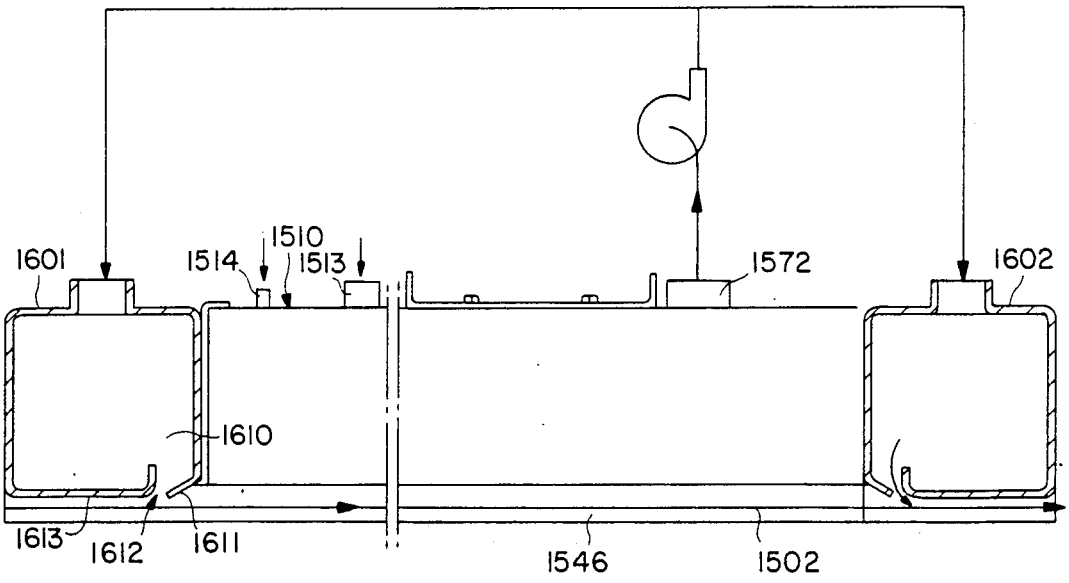
Figure 19:
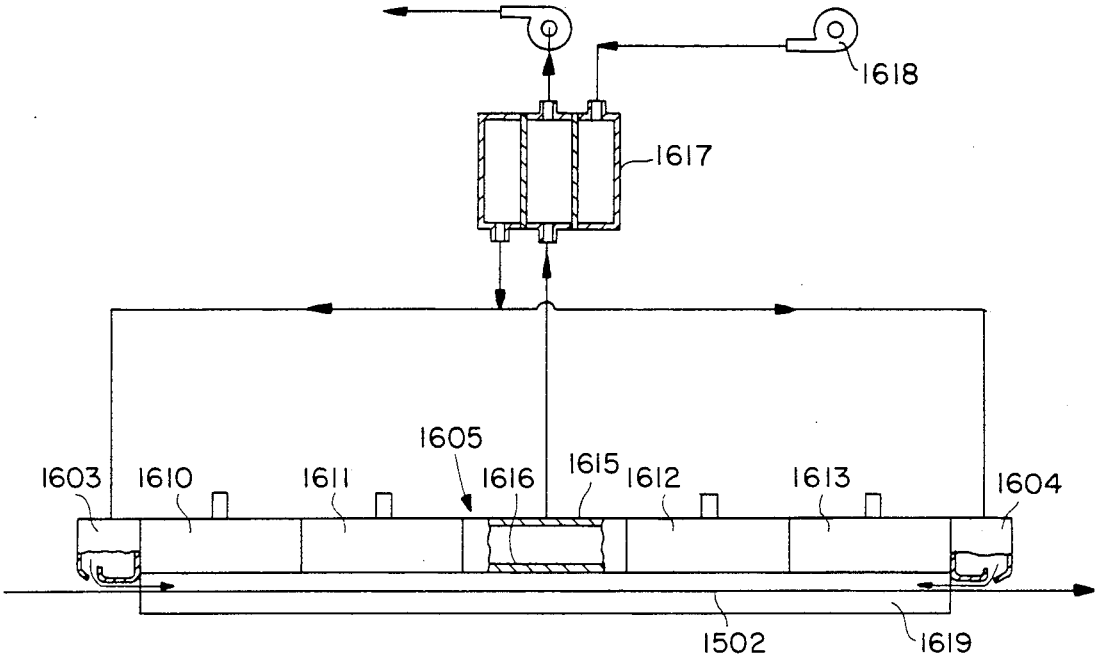
Figure 23:
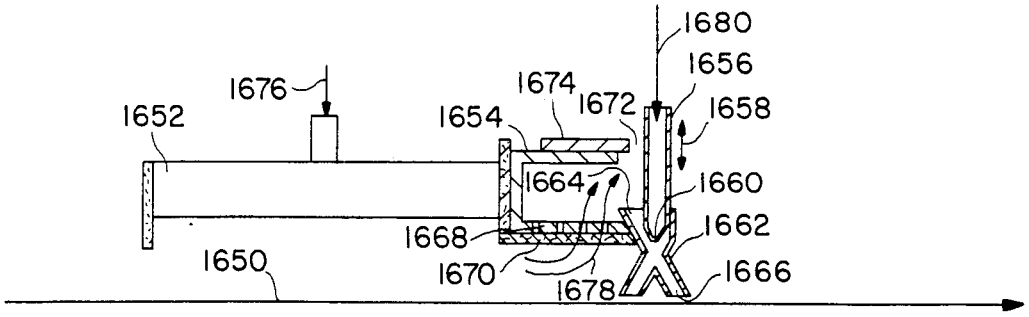
Figure 20:
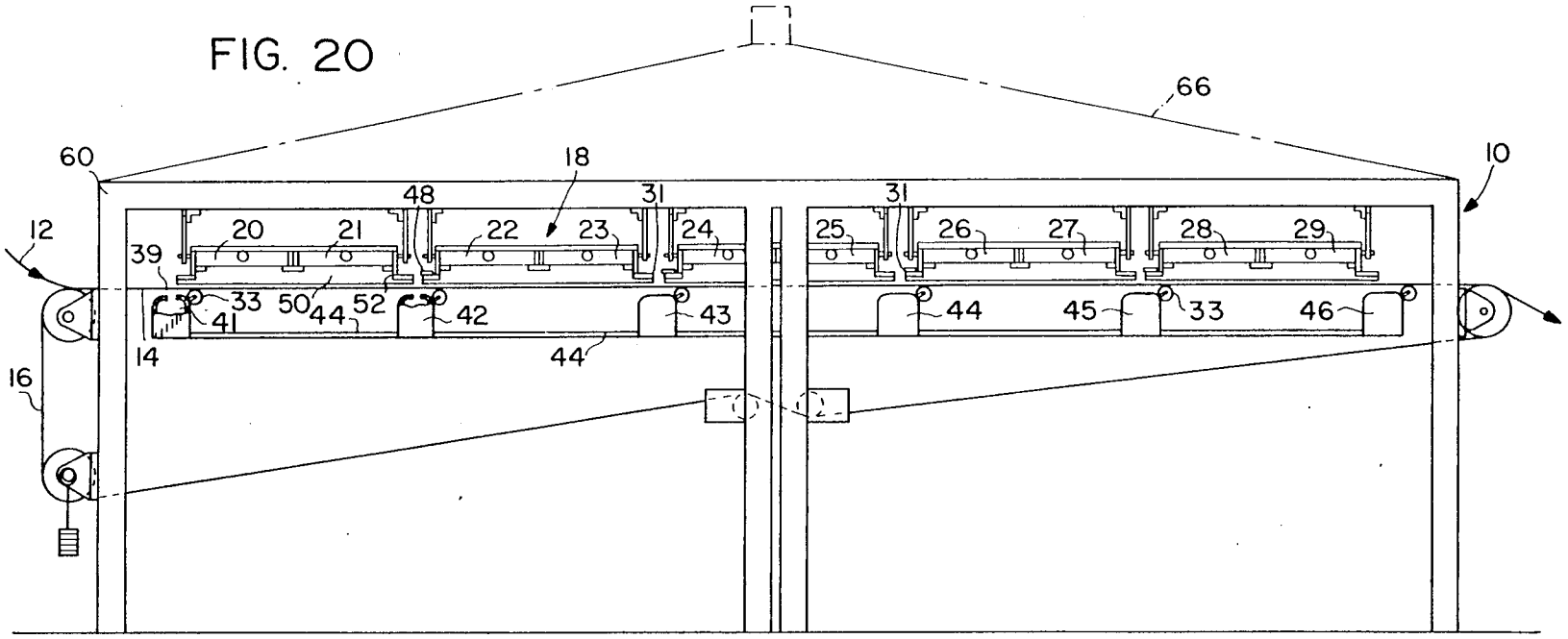
Figure 21:
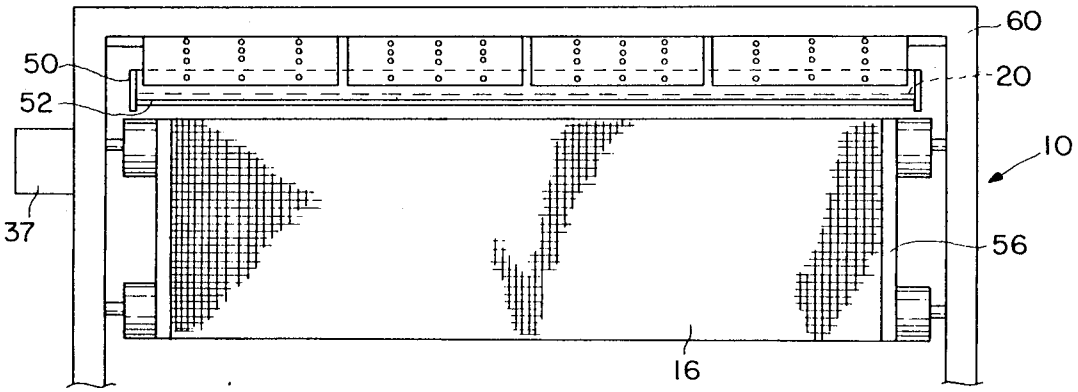
Figure 24:
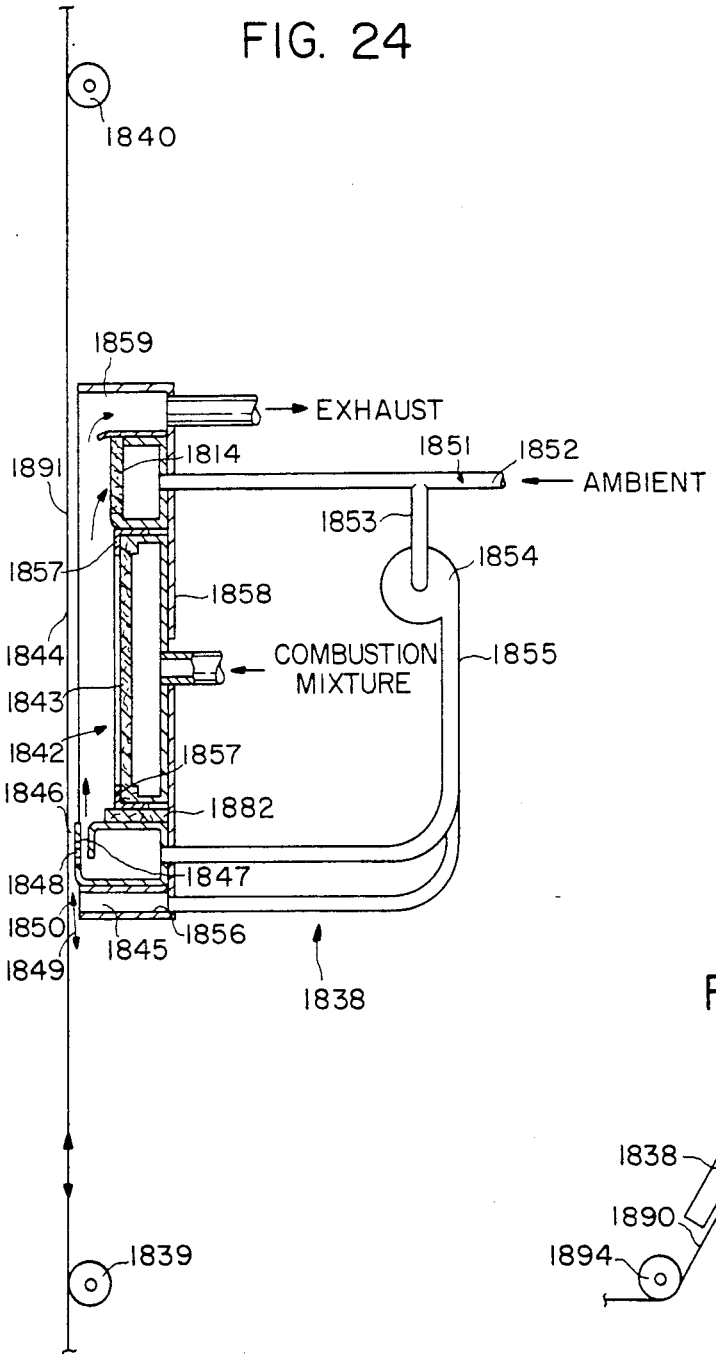
Figure 25:
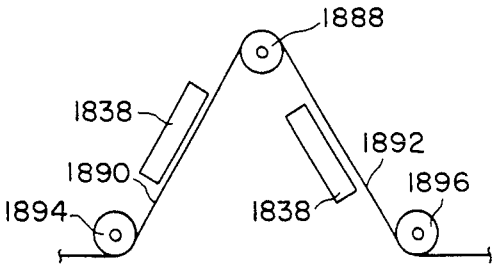
Figure 27:
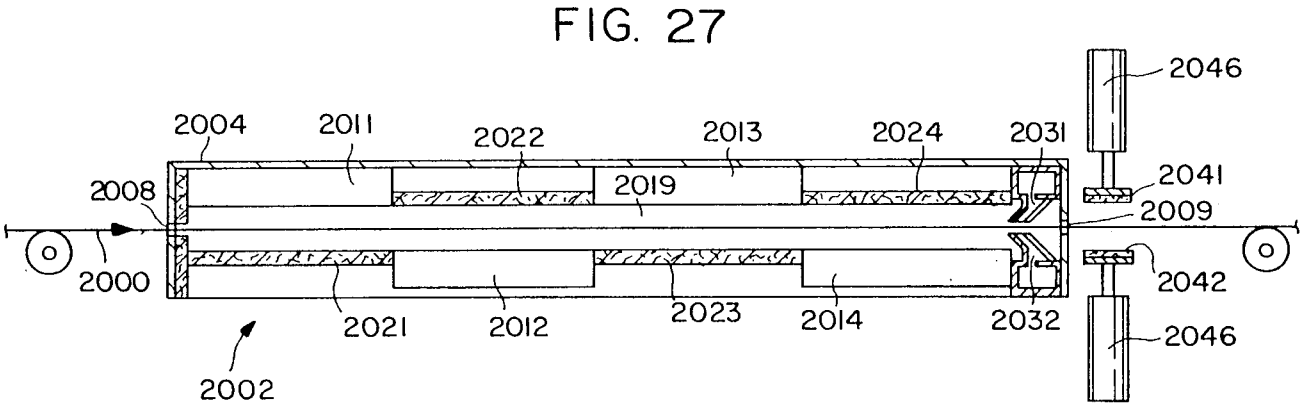
Figure 26:
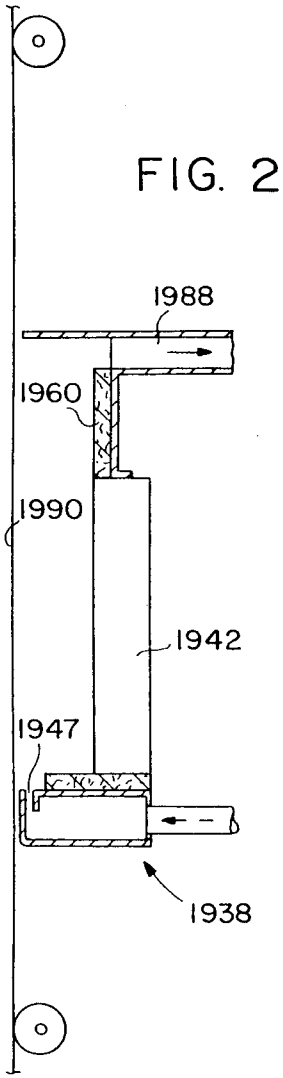
Figure 28:
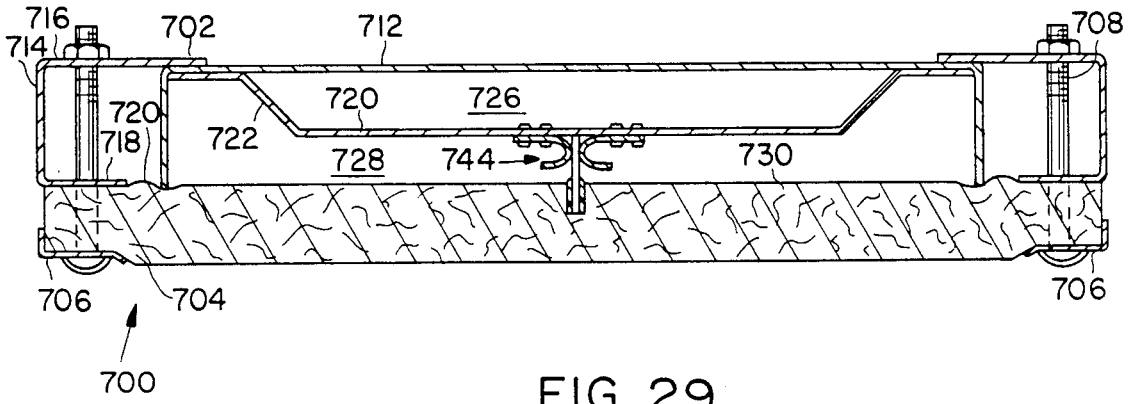
Figure 29:
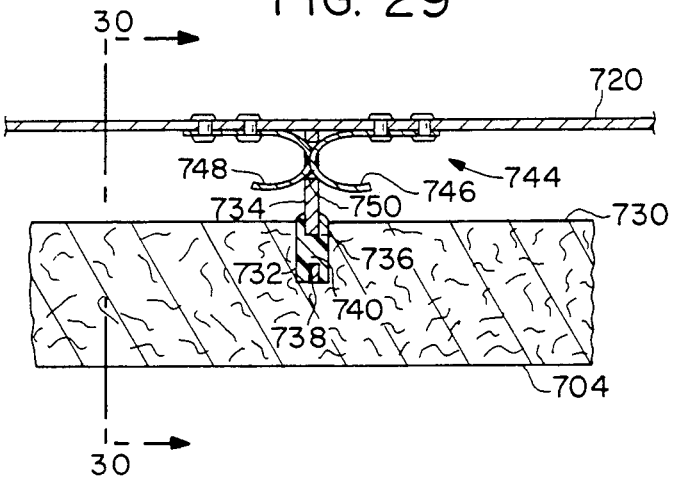
Figure 30:
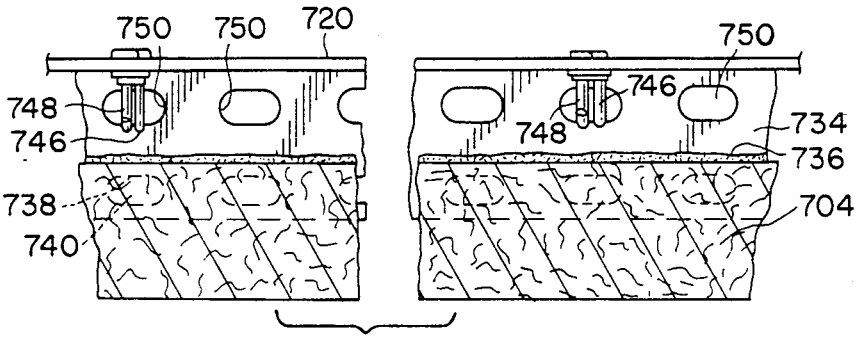
Figure 31:
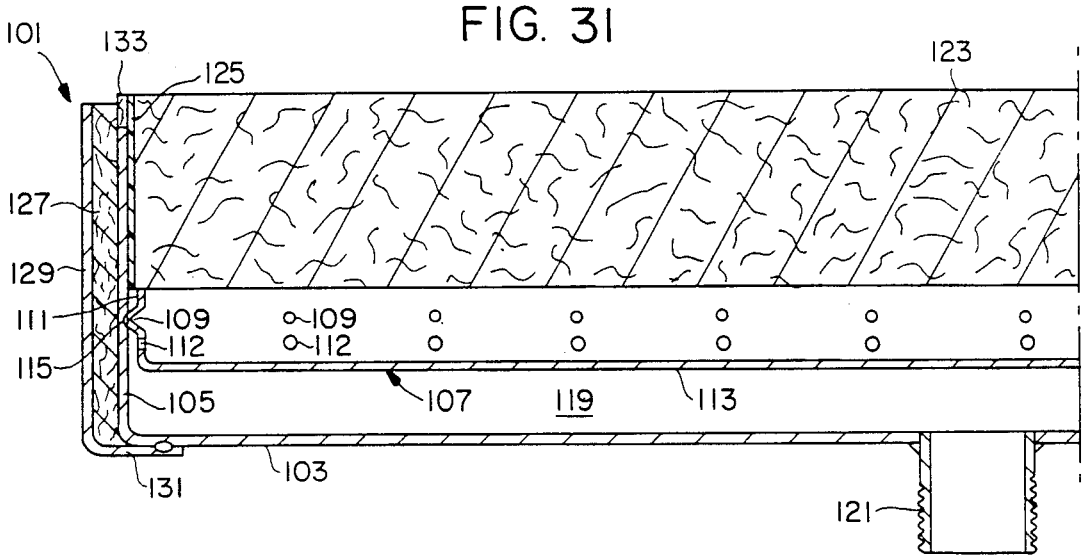
Figure 32:
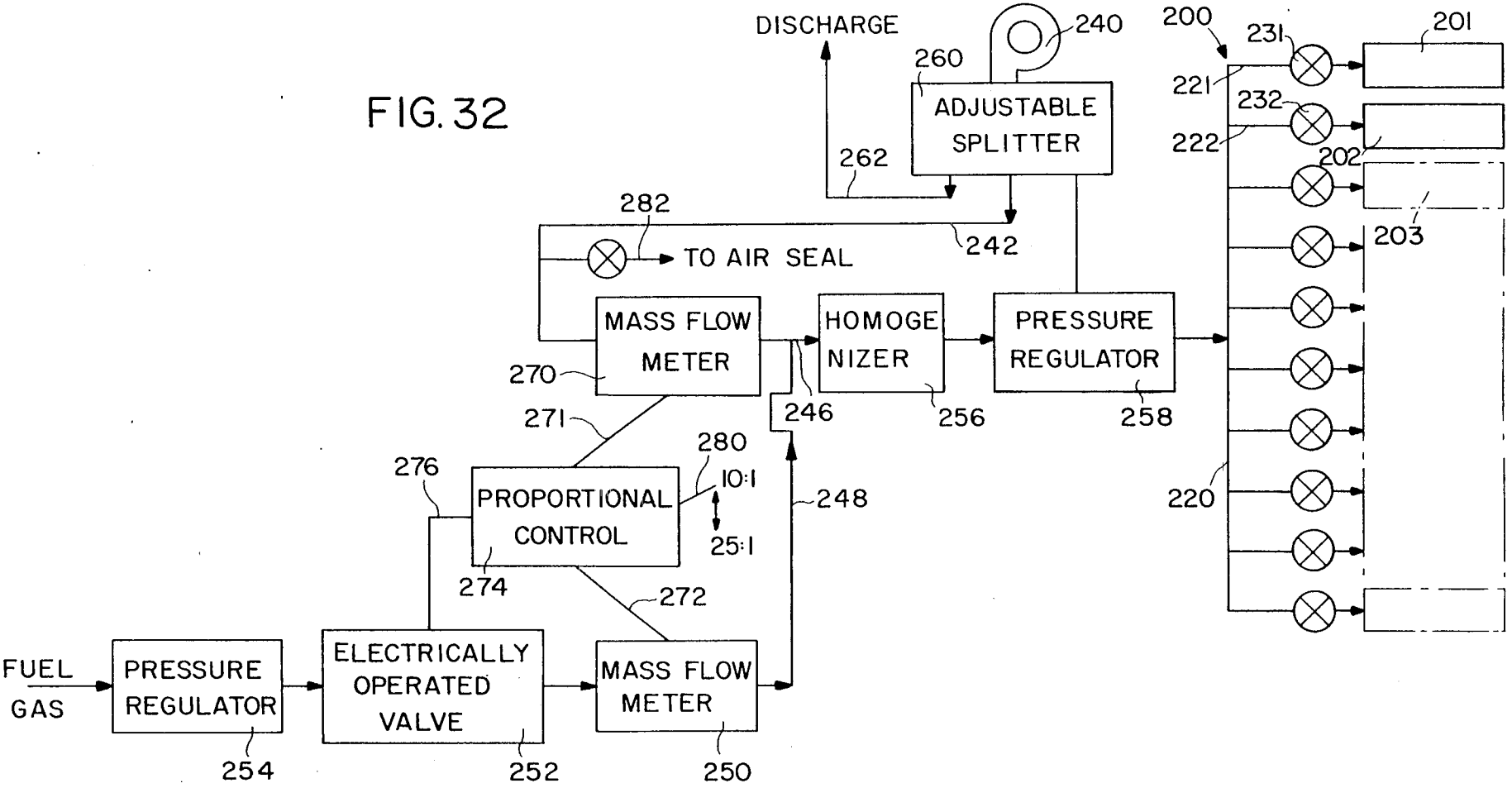

FIG. 10 schematically illustrates the making of corrugated board pursuant to the present invention;

FIG. 11 is a schematic side view of further embodiments of the present invention;

FIG. 12 is a detailed side view with parts broken away, of a burner of the construction of FIG. 11;

FIG. 13 is a view of the burner construction of FIG. 12, taken from the face of the burner;

FIGS. 14, 15, 16 and 17 are schematic side views of additional heating apparatus typical of the present invention;

FIG. 18 is a partly sectional view of a variation of the FIG. 1 apparatus, modified for use in heat-treating webs;

FIG. 19 is a somewhat diagrammatic view of a further modified heating apparauts of the present invention;

FIG. 20 is a side view of yet another web-heating apparatus incorporating the present invention;

FIG. 21 is a view of the apparatus of FIG. 20, taken from its inlet end;

FIG. 22 is a front view of an apparatus for irradiating the edges of sheets in accordance with the present invention;

FIG. 23 is a partly detailed side view of a modified embodiment of the apparatus of FIG. 20;

FIG. 24 is a somewhat diagrammatic sectional view of a further modified embodiment;

FIGS. 25, 26 and 27 are very schematic side views of variations of the embodiment of FIG. 24;

FIG. 28 is a vertical sectional view of a downwardly firing burner with a specially re-enforced matrix;

FIG. 29 is an enlarged detail view of the re-enforcement of FIG. 28;

FIG. 30 is a side view of the interior of FIG. 29, looking from line 30—30;

FIG. 31 is a sectional view of a burner such as that of FIG. 24, but further modified;

FIG. 32 is a schematic illustration of a burner control technique pursuant to the present invention.

Figure 33:
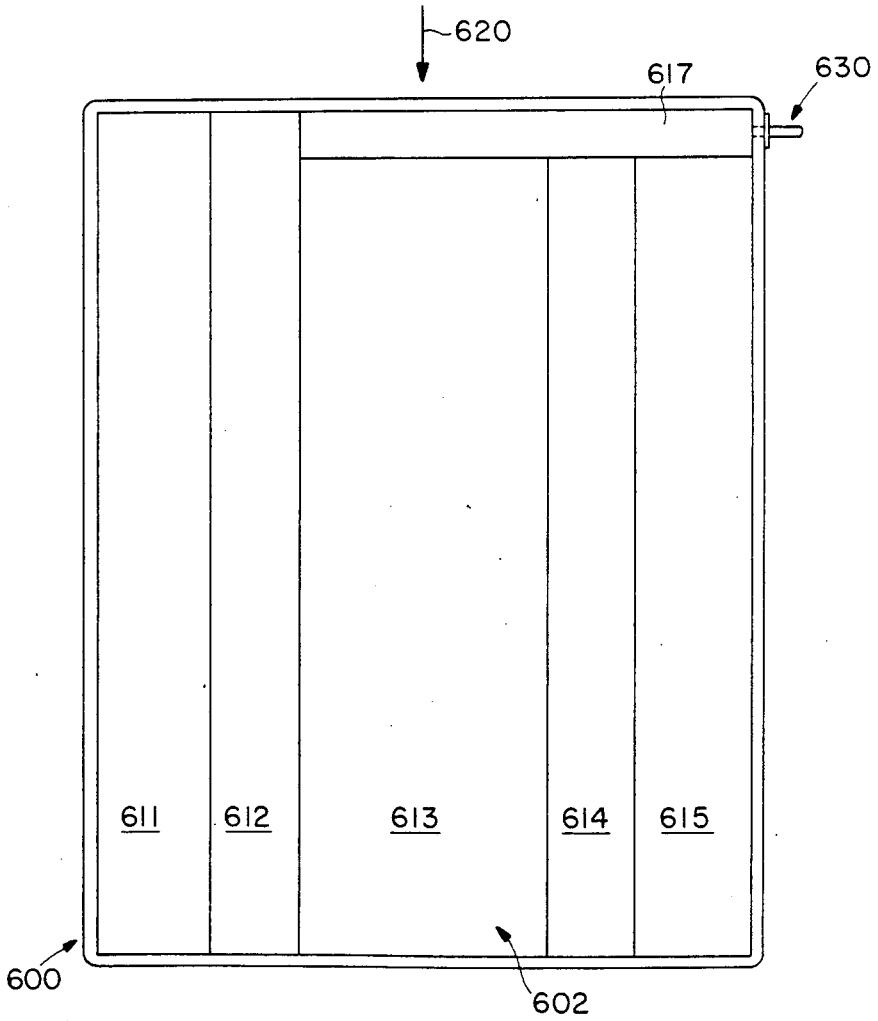
Figure 34:
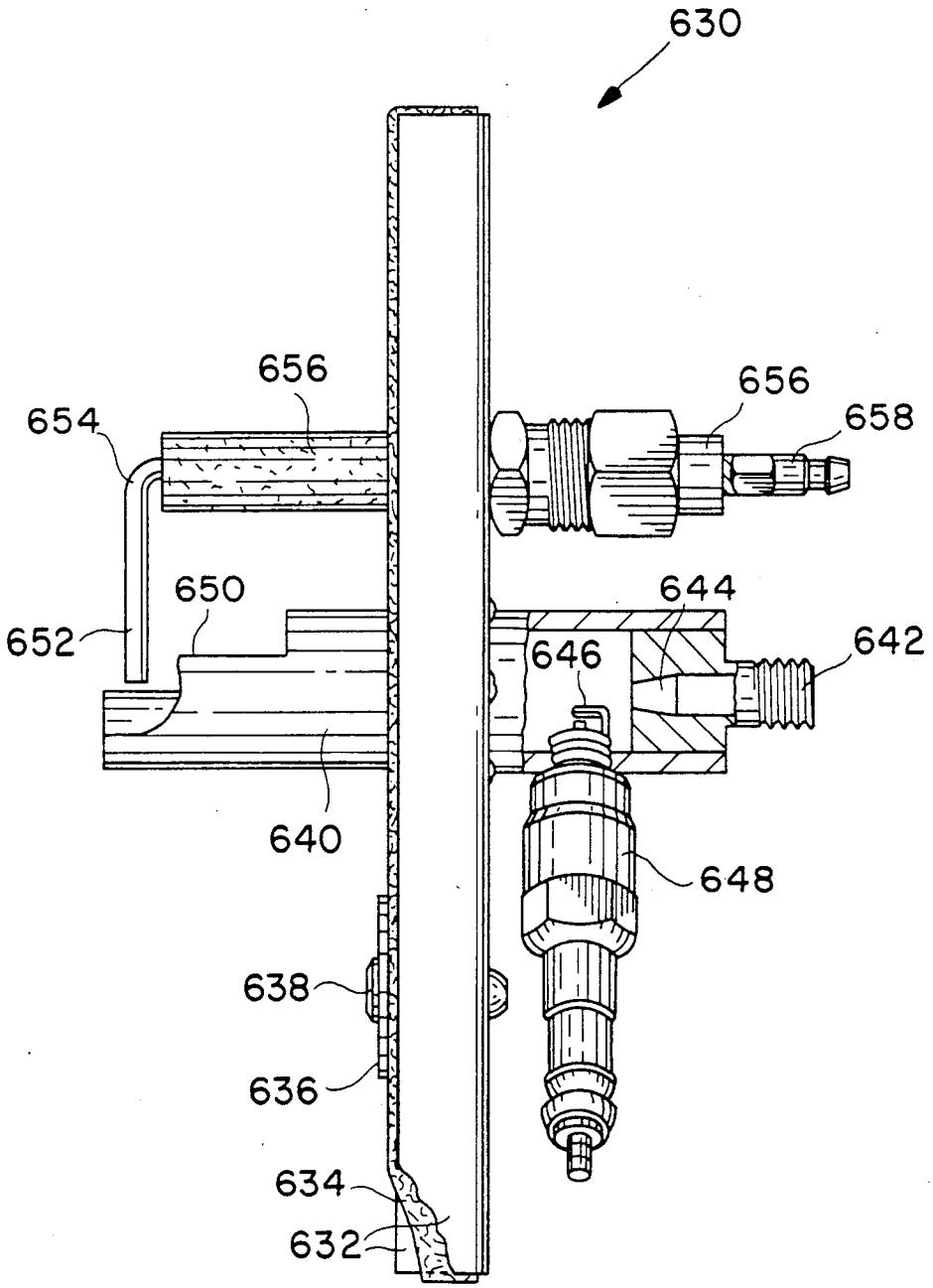

FIG. 33 illustrates the face of a burner aray according to the present invention; and FIG. 34 is a partially broken away view of an igniter according to the present invention.

The infra-red generators of the present invention generally have a felted fiber matrix pad with extended surfaces and at least about ½ inch thick, through which pad a gaseous combustion mixture is passed to emerge from one surface and to burn at that surface to heat that surface to incandescence and thus generate infra-red energy. Generators of this type are described in the above-noted parent applications and patents.

The matrix pad for a generator of the foregoing type can consist of at least two separate pieces of matrix butted together in edge-to-edge contact, the abutting edge faces being adhered to each other with a layer of silicone rubber not more than about 3 millimeters thick.

In such a cemented-together matrix pad it is preferred that the pad have its edges clamped in place in the generator, with each separate matrix piece extending to at least one of said edges.

Turning now to the drawings, the burner 10 of FIG. 1 has an elongated metal plenum trough 12 whose floor is shown at 14 and side walls at 16, 18. The floor can be 14 by 120 inches in size, by way of example, with side walls 16 then 14 inches long, and side walls 18 120 inches long. The heights of the side walls need only be about 2½ inches or even as little as 1⅜ inches.

Around the periphery of the plenum trough 12 is secured a metal air-seal channel 20 having a web 22 and unequal flanges 24, 26. As illustrated flange 26 is longer than flange 24 and is spot welded by a series of spots, as at 28, to the bottom of plenum rough floor 14.

The corners of the plenum trough and of the air-seal channel are welded together as shown for illustrative purposes in FIG. 2. Weld 30 is a gas-tight joint between side walls 16 and 18. At the burner corner where air-seal webs 22 meet, a vertical weld 32 joins these webs, and additional welds 34, 36 join the flanges 24 together, and while these three welds can also be gas-tight, this is not essential.

The corner construction of the air-seal channel 20 as illustrated in FIG. 2 is made by notching out a square section of web 24 at the end of one rail 41 of the channel, and fitting the un-notched end of the adjacent rail 42 into place. The other flanges 26 of the channel rails can be similarly formed and assembled.

In many cases it is advantageous to use the corner construction of FIG. 2 because square notching can be performed more accurately tha mitered notching as shown in U.S. Pat. No. 4,035,132. The product of FIG. 2 will then be simpler to weld together, even though a little extra welding is needed, and will present a better appearance. It is not necessary to weld or otherwise join together the flanges 24, 24 at a corner of the burner body. Indeed by providing a gap between these flanges at those locations the matrix-covering flange of the hold-down frame 20 is better permitted to undergo thermal expansion when the burner is in use, with less warpage of the frame. A similar technique for reducing warpage is shown in U.S. Pat. No. 3,824,064.

If desired the side walls 16, 18 of the plenum trough can have their upper edges provided with a short horizontally extending lip as shown in U.S. Pat. No. 4,035,132, in which event the lip can have a corner construction corresponding to that of the air-seal rail flanges.

Burner 10 has a porous matrix pad 50 positioned over the flanges 24 and upper edges of side walls 16, 18. The matrix pad is clamped in place by a rectangular hold-down frame 60 that extends around the periphery of the pad and is secured to flanges 24 by a series of attaching screws 66. These screws can be threadedly engaged in spring clips 68 fitted over holes 70 in the flanges 24, or in nuts held in these holes by nut-holding clips or the like.

Frame 60 is provided with screw-receiving holes aligned with holes 70, and the screws are drawn up tightly enough to compress the matrix edges as described in U.S. Ser. No. 775,838 an substantially reduce the porosity of those edges. The matrix pad is preferably of self-supporting although somewhat resilient construction about an inch or 1⅛ inches thick with its edges compressed down to about 90% of its uncompressed thickness. The frame can have a notched corner construction similar to that of the air-seal rails shown in FIG. 2.

Because of the length of the burner, the matrix pad is made up of two pieces 51, 52, adherently united by a thin layer 53 of silicone rubber sealant. The joint is a simple butt joint and the adhesive layer thickness no greater than about 3 millimeters. The sealant is non-porous, but such a thin layer of sealant blocks off only a small and inconsequential portion of the face of the matrix pad. As a result the slight gap in the area over which the gaseous combustion mixture burns at the outer face of the pad, is of no consequence.

In use the incandescent condition of the surface fibers of the mat on both sides of the sealant layer 53 will cause the outermost portion of that layer to also get very hot and can partially decompose that portion. However, the movement of the cool combustion mixture through the inner fibers of the matrix keeps them cool and also keeps the inner portions of the thin sealant layer cool. Thicker sealant layers are not kept so cool and show more thermal degradation. With the 3 millimeter thickness, the adhesive joint need only be about ½ inch deep to have a useful life of many months of operation. Best results are obtained with the adhesive extending the entire depth of the matrix.

The foregoing butt joint is much simpler to make than the tongue-and-groove joint used in the prior art with a sodium silicate type of adhesive deposited from aqueous solution. That prior art type of joint is actually more porous than the adjacent portions of the matrix, and tends to make the generation of infra-red energy much less uniform.

The butt joint can also be modified by connecting together two matrix lengths with the held of a metal foil both faces of which are coated with a thin layer of sealant such as silicone rubber. The overall thickness of the double-coated foil should also be not more than about 3 millimeters, even when the foil is a good heat conductor like aluminum. Some of the foil, with or without coating on it, can be permitted to project into the plenum, but there should be no projection beyond the outer face of the matrix.

As in the constructions of the patent applications, the burner 10 is provided with connection nipples to supply the plenum with combustion mixture and to supply air to the interior of the air-seal channels. A nipple 71 for the plenum is shown as welded into trough floor 14 and a simple deflector baffle 72 welded above it to the inner face of that floor. That baffle is a short length of a channel that has only a body web 73 and two flanges 74, and is very simply tack welded as at locations 75, to the trough floor 14. If desired the baffle can be further simplified, as by making it a metal tab much like the bent tab baffle 76 shown for the air nipple 77, but having the bending angle an obtuse angle. One tab off such baffle can then be spot welded to the top of trough floor 14 alongside the nipple 71, to hold the remainder of the baffle at an angle over that nipple.

More than one combustion mixture supply nipple is used with burners as large as 120 inches. Two such nipples are enough, however, especially if symmetrically located about 60 inches apart along the burner's length, when the plenum is not partitioned into separate compartments. The plenum can be easily partitioned as by welding a sheet metal panel 81 in place in the trough, in which event there should be at least one combustion mixture supply nipple for each plenum compartment.

Panel 81 preferably does not extend into the air-seal channel, and it is not necessary to partition off the air seal, although this can be done as by a similar partition panel, if desired. The air-seal slot 58 by which air is discharged from the air-seal channel through the entire margin of the matrix pad, is preferably kept unobstructed. A gas-tight seal can be provided between partition panel 81 and the walls and floor of the plenum trough, but a simple spot welding is enough if the combustion mixture supply nipples are connected to gas and air sources arranged to supply only air to any plenum compartment that is not being fired while an adjacent compartment is being fired. The air pressure in the unfired compartment can then be made equal to or a little greater than the combustion mixture pressure in the fired compartment, to reduce the danger of combustion mixture leakage around the partition.

For some uses of the burners, they are arranged to generate infra-red energy over a variable length. Thus, in the pre-drying of a wet fabric in a textile mill, the fabric processed can sometimes be as narrow as 30 inches or so, and sometimes as wide as 120 inches. The burners can then be partitioned as for example to provide a central plenum compartment 30 inches long, plenum compartments 20 inches long on either side of the central compartment, and plenum compartments 25 inches long at each end of the plenum. The appropriate compartments can then be fired to match the width of the fabric that is passed transversely in front of the burner for exposure to the infra-red energy.

It is preferred to have the hold-down frame 60 so dimensioned that its peripheral flange 61 lies in the same general plane as air plenum web 22 at all sides of the burner. This makes it unnecessary to have flanges 61 accurately located so as to fit around webs 22, and also uses less metal in frame 60.

It is also preferred to cut frame 60 into short lengths, such as 15 to 20 centimeters, each separately held in place by bolts that penetrate through to the burner back.

The air nipple 77 can be mounted in the end wall 22 of the burner instead of in the burner back, if desired, in which case baffle 76 can be eliminated. Also, said end placement can be duplicated on both ends of a burner, and the projecting air nipples and/or the pipe connections to them make convenient hanger mountings be which a burner can be held in pipe straps or U-bolts, for example. Such pipe straps or U-bolts can slidably hold the nipples or pipe connections, so as to more readily allow for thermal expansion of the burner body as it heats up and cools down.

The matrix pad can have more than one joint 53, and such joints can be located within a few inches of each other, if desired. It is preferred however that each piece of matrix thus joined have an edge secured under the hold-down frame 60. Where the matrix pieces being joined have good edges at the joint, no special preparation is needed. Where those edges are damaged or out of true, they can be readily cut as by a table saw with a fine-toothed saw blade, to provide true edges. The silicone sealant is sufficiently viscous that it can be spread over a matrix edge without penetrating into the matrix fibers more than about ½ millimeter. Any of the commercially available silicone sealants are suitable. Sealants made of lower temperature non-porous materials such as natural rubber or neoprene or epoxy resins, can be used in place of the silicone sealant but they degrade more severely when the matrix they unite is fired, and so are not preferred. The use of a rubbery sealant such as silicone rubbers is helpful in that the curing of the sealant does not convert it to a hard material that could cause damage to the matrix fibers when the matrix is flexed during handling.

Figure 3:
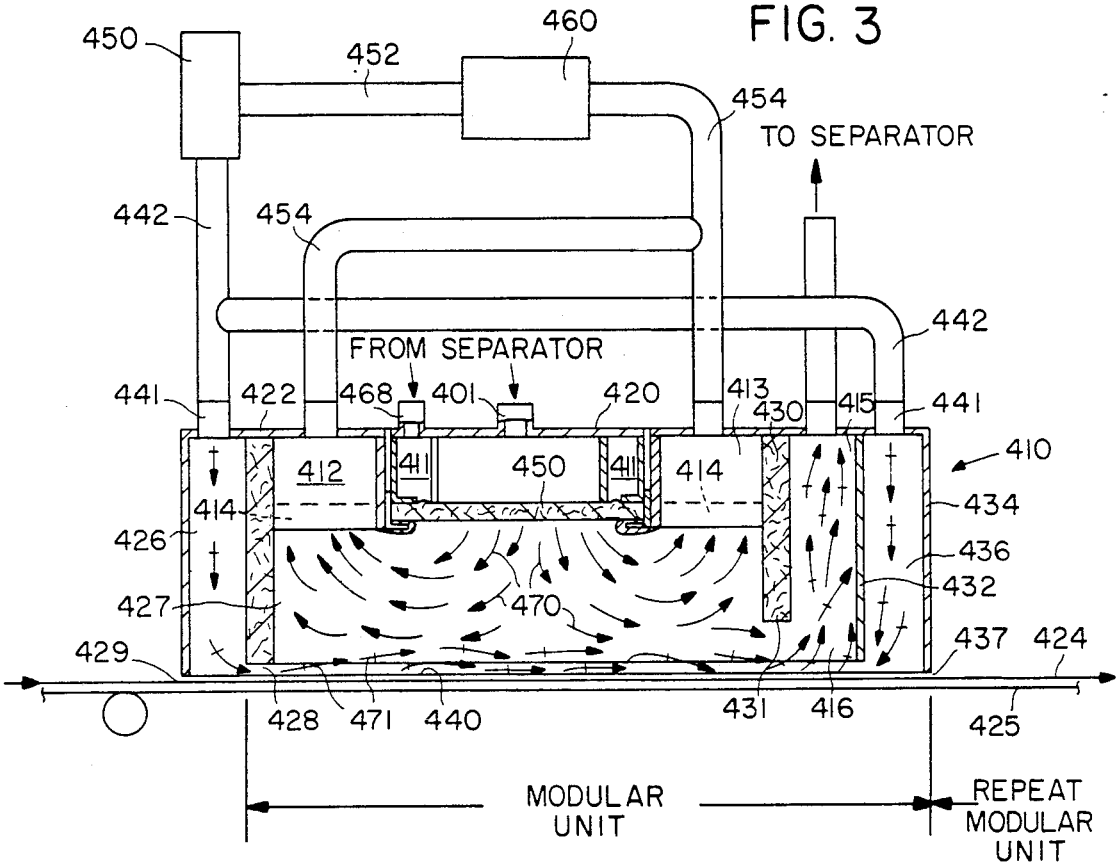
FIG. 3 is a vertical sectional view of a burner installation for drying a continuously moving web.
Figure 4:
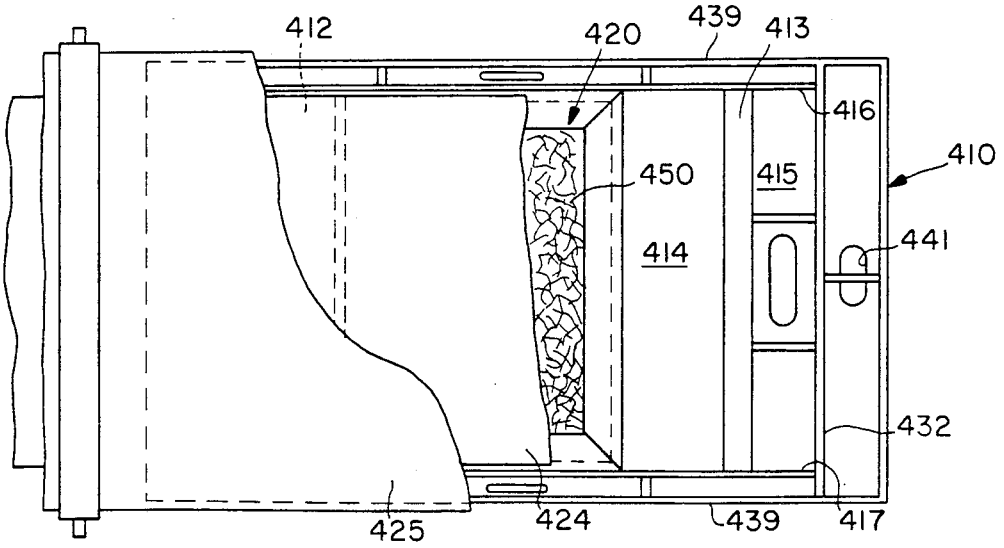
FIG. 4 is a plan view, with parts broken away, of the assembly of FIG. 3, looking up at its lower face.

FIG. 3 and 4 show a burner assembly particularly suited for heat-treating moving webs carrying volatilizable material that contaminates the atmosphere if merely discharged into the air. Here a web 424 of freshly printed or coated paper as it moves from the printer or coater is passed under a heat-treater 410, and can be supported by a conveyor belt 425 or a series of idler rollers, or even a fixed supporting surface.

Assembly 410 contains a gas-fired burner 420 firing downwardly and having its incandescent face 450 spaced at least three, preferably four, inches from the paper web. On opposite sides of the burner are draw-off boxes 412. 413 having floors covered with porous reradiators 414 as described in parent Ser. No. 292,167.

Upstream of draw-off box 412 is a thermally insulating partition 422 that descends to about one inch or less from the paper 424, to provide an entranceway 428 for a shallow stream 440 of flushing gas delivered through external conduit 426. The upstream lip 429 of conduit 426 is even closer to the paper 424, than partition 422.

Downstream of draw-off box 413 is another thermally insulating partition 430 extending downwardly toward the paper. The lower edge 431 of this partition is as far from, or a little farther from, the paper than the lower edge of partition 422. Downstream of partition 431 is a collection chamber 415 defined by wall 430 along with side walls 416, 417 and a far partition 432. An end wall 434 further downstream provides another external conduit 436, and like external conduit 426 the lower lip 437 of the external wall 434 of conduit 436 is located very close to the paper 424.

External conduits 426, 436 can be continued through side jackets 439, and can be interconnected that way to provide a peripheral enclosure through which gas is flowed downwardly to act as a curtain along both edges of the paper as well as upstream and downstream of the assembly 410. Upstream conduit 426 preferably has a depth in the upstream-downstream direction somewhat greater than that of the downstream conduit 436, so as to provide the extra gas that makes the shallow stream 440.

Both conduits 426, 436, as well as the peripheral jackets, are provided with intake connectors 441 and supply ducts 442, the latter being shown as joined together and forming the outlet for a blower 450. The intake 452 of the blower is fed from ducts 454 connected to draw-off boxes 412, 413. A heat exchanger 460 can be fitted in ducts 454 to cool the gases sucked from boxes 412, 413 into the blower.

The apparatus of FIGS. 3 and 4 is operated by introducing a stream of gaseous combustion mixture into burner inlet 401, igniting the combustion mixture as it flows out from face 450, and passing the paper 424 to be treated under assembly 410. Ignition is conveniently effected by sparking using the electrode arrangement described in parent application Ser. No. 952,332.

Blower 450 is operated to suck the very hot combusted gases through draw-off boxes 412, 413 and after they are cooled to about 400° F. or below, to blow then through conduits 426, 436, and the side curtain jackets 439. This provides the shallow stream 440 that flushes across the surface of the paper and carries off vapors of organic printing or coating solvent or the like. Stream 440 with those vapors is in turn drawn off through chamber 415 and can then be led to a separator for separating out those vapors, as by cooling to condense them out as liquids.

The path of the gaseous combustion products as they leave the burner face 450 and move to the draw-off boxes is shown by the plain arrows 470. The path of the shallow stream is shown by the primed arrows 471.

Burner 420 is shown as a ceramic fiber matrix type burner, and can be fed a gas-air combustion mixture that is exactly or approxiamtely stoichiometric. Its combustion products will then contain little or no oxygen, and the gas-containment effected by the gas curtains in the construction of FIG. 3 will sharply restrict or completely prevent the leakage of oxygen-containing air into those combustion products as they move through the above-described circuit. There is accordingly little or no risk of explosion even when the vapors swept from the paper are highly combustible in air. Wire screen burners also provide similar stiochiometric control of oxygen in their gaseous combustion products.

Stream 440 is preferably kept as shallow as practicable, inasmuch as this reduces the volume of gas mixture from which the vapors are to be separated. Some of the combustion gases leaving burner face 450 can be bled off to the atmosphere downstream of blower 450, in the event the gas curtain around the periphery of assembly 410 does not dissipate all the excess gas.

Burner 420 is desirably of the air-seal type having around its margin a sealing plenum 411 described in the parent applications. Although this plenum can be fed air at its intake 468 without adding too much oxygen to the burner's combustion products, it can also be fed with recirculating combustion products. Temperatures as high as 350 and even 400° F. can be tolerated for gases fed to the sealing plenum 410.

Alternatively the gas supplied to seal plenum inlet 468 can be some of the gas separated from the gas-vapor mixture. Thus where the vapor separation yields a recovery stream of vapor-free gas, the contaminated gas can be fed to plenum 411. In the event the contaminating vapor is carbonized or converted to other undesired solids by the hot combustion gases, a little extra air can be added to the air-seal gases to help burn up such solids.

The separator to which is fed the vapor-containing gas from collection chamber 415, can merely be an abosrption canister such as one containing a quantity of charcoal on which organic vapors and the like are trapped and held while oxidation products like $C0_2$ and water vapor pass through. Such an absorption canister becomes saturated with trapped vapors after a length of use, and when that happens the vapor-containing gas from 415 can be switched to a fresh absorption canister while the saturated one is rejuvenated and thus prepared for re-use. Rejuvenation is readily effected as by inserting the saturated canister in the air supply to burner input 401 so that the vapors trapped in the canister are flushed out by that incoming air and burned with the combustion mixture. The flushing out is made more effective by heating the canister as it is being flushed, preferably to a temperature above that at which it traps the organic vapor from compartment 415, and such extra heating is readily supplied by exhaust conduit 454 and/or heat exchanger 460. The trapping and flushing is conveniently effected by simple valve action that shifts the flow of exhaust gases and heating gases, so that the apparatus can be used without interruption.

Heat exchanger 460 can be used to provide heat for other purposes. However the combustion mixture entering burner inlet 401 can be heated somewhat by heat exchanger 460 inasmuch as a limited amount of such heating, i.e. to bring the incoming combustion mixture to about 200° F., will not damage the burner and will actually increase its thermal efficiency. Where the vapor is combustible and not sufficiently valuable to be recovered, gas-vapor mixture can be supplied from chamber 415 to seal plenum intake 468, after only a little cooling. Such recycled vapor will be burned as it enters the combustion zone of burner 420, and where its combustion products are only oxides of carbon and hydrogen, does not create any problems. The content of vapor in such recycled mixture is generally too low to call for an adjustment of the air-to-gas proportion fed to burner 420, but such an adjustment can be made, if desired.

The shallow flushing stream 440 is substantially cooler than the hot gaseous combustion products above it as it passes beneath the burner, and so tends to remain close to the paper even if it becomes further heated during such passage. Some movement of the hot combustion products into the narrow stream 440 can be tolerated, but it is preferred not to have any of the stream 440 work its way into a draw-off box 412 or 413. A temperature difference of at least about 400° F. between the stream 440 and the hot gaseous combustion products discharged by burner 420, is quite effective for this purpose.

Where more assurance is desired that stream 440 stay in place, or where that stream is to be made as shallow as ½ inch or shallower, a thin sheet of infra-red-transmitting material such as quartz can be fitted between partitions 422 and 430 to help contain that stream. In such an arrangement the temperature difference between stream 440 and the hot combustion producst above it, can be less than 400° F. The shallow stream should however not be so hot as to damage the paper 424.

The face of burner 420 becomes quite hot in use, and any metal members exposed to that heat are preferably covered with thermal insulation, as described in the parent applications, and the metal subdivided into sections that are spaced from each other to better allow for thermal expansion and contraction. Metal supports or retainers for thermally insulating partitions and the like can be similarly subdivided.

A belt conveyor used with the construction of FIGS. 3 and 4 can be porous or non-porous. A porous belt such as described in U.S. Ser. No. 312,730 is preferred.

Where the paper 424 or other material being heated is moving at a very rapid rate or contains very large quantities of volatiles, a second assembly 410 can be mounted at the downstream end of the first assembly to provide more heating and more vapor flushing. Conduit 436 of the second assembly can then be eliminated inasmuch as its sealing function is not needed. The shallow flushing streams of both assemblies can be kept separate, or can be combined as by also eliminating chamber 415 from the first section, or the conduit 426 of the second sections, or both.

In the event the paper 424 is to be printed or coated on both faces, a separate assembly 410 can be arranged to separately treat each face.

The web to be treated can also be moved in an inclined or vertical direction. Where there is an appreciable inclination of the web path, the lower draw-off box for combustion products can be omitted and the upper one made larger. For vertically-moving webs both faces of which need treatment, a separate burner assembly can be applied against each face, with the shallow vapor-flushing stream moving upwardly or downwardly. Preferably the flushing streams move counter-current to the web.

Webs can have their lower faces treated in the manner shown in FIGS. 3 and 4, as by using an inverted burner assembly having an inserted infra-red-transmissive gas barrier close to the lower face of the web. The shallow vapor-flushing stream will then be above the burner, and applying a small superatmospheric pressure to that stream will help keep the web being treated from sagging too much.

The webs printed or coated on one face, can have their opposite faces exposed to the infra-red irradiation, with a shallow stream of vapor-flushing gas directed along the printed or coated face. The web itself will then separate the vapor-flushing stream from the combustion gases produced by the intra-red generation. Where the webs are somewhat transparent to the infra-red energy, damage by overheating is easily controlled by limiting the raidation. Special cooling of the web is accordingly not needed unless the web is quite thick. The heat treatment can be immediately followed by cooling with very cool air or by engagement with a water-cooled roller, to shorten the time during which the web remains hot. Such cooling is best applied to the face that was irradiated.

Where it is desired to recover the vaporizable solvent in more or less anhydrous condition, the vapor-flushing gas should have a minimum of moisture content. Using unsaturated fuels such as pentadienes, butadiene, pentylenes, butylenes, propylene and/or ethylene, to fire the burners, yields combustion products having much less moisture content than that resulting from burning natural gas. The moisture content of those combustion products can be further reduced by passing those products through a moisture reducer such as steel wool which reacts with water vapor at elevated temperatures. Such reaction converts the reacted water vapor to hydrogen in amounts that can be over 10% by volume of the resulting combustion products.

Combustible vapors in the exhaust from compartment 415 can also be oxidized before venting by passing the exhaust, along with excess air, through an oxidizing chamber nearly filled with porous ceramic blocks impregnated with finely divided platinum. At the high temperatures of that exhaust vapors readily oxidize upon contact with the platinum.

The vapor-containing burner exhaust can be withdrawn thropugh the draw-off boxes 412, 413, and compartment 415 omitted. The flushing gases 426, 436 then help guide toward those compartments the gaseous atmosphere under the burner, and minimize leakage of that atmosphere out through the spaces between the paper web 424 and assembly 410. A controllable proportion of air can be introduced into the recirculating gases to lower their temperature an/or introduce some oxygen to assist with the burning of vapors emitted from the web.

Alternatively, the heat exchanger 460 can be used to cause the hot combustion products to heat oxygen-poor gas such as that recovered after freezing out the solvent vapors. This heated gas is then passed through duct 452 to form the shallow vapor-stripping stream. A gas stream so supplied would have its water vapor frozen out along with the solvent vapors.

Burners other than of the ceramic fiber matrix type can be used in place of burner 420, and a ceramic fiber burner without an air-seal such as described in U.S. Ser. No. 952,332 can also be used. Alternatively cooling of the metal structure of the burners can also be arranged as by having water conduits brazed to that structure as described in U.S. Ser.No. 186,491.

The gas fired infra-red generators can also be used to heat sheets or webs formed by dry felting fibers that are to be bonded together. Thus some of the fibers can be made of, or coated with, thermoplastic resin that on heating and pressing will bond to the remaining fibers and hold the web together. Such a web-forming technique can use fibers from many sources, including fibers reclaimed from paper-making broke or from used newsprint. Thermoplastic resins that can be used as bonding agents include polystyrene, polyethylene, and polypropylene. The resin fibers so used can be manufactured by extruding or spinning a lower-melting resin over an inner filament of a higher-melting resin or other material. Such two-layer fibers do a better job of bonding over a temperature range wider than that suitable for any one resin.

Where the dry-felted web is porous, it is preferably heated while supported by a porous conveyor, with suction applied to draw at least some of the hot combusted gases through the web and the conveyor, as described in parent Ser. No. 312,370.

In the event web 424 can have different widths, burner 420 is preferably compartmented as described above. A series of combustion plenum compartments can thus be provided at each edge of the web, and these compartments can be as little as one or two inches wide; to accommodate small changes in the web width.

For maximum heat treatment of rapidly moving webs, heating assemblies can be provided on both sides of the web, and to save space such assemblies can directly face each other, with the intervening web relied on to keep the opposing burners from overfiring each other. It is practical, however, to leave about an inch of burner face exposed to an opposing burner just beyond the edge of a web, inasmuch aw such exposure will generally not cause trouble and may simplify the burner compartmentation.

Instead of heating a web, a burner assembly can be used to heat a row of individual articles being advanced on a production line. Thus, a series of wire coat hangers can be hooked over an advancing screw that moves them through a coating station at which adhesive is applied to the lower length of wire on each hanger, then to a flocking station at which fiber flock is applied over the adhesive, and finally through a heating station where a gas-fired infra-red burner positioned face up heats the flocked wire and sets the flocking adhesive. Only a few seconds exposure to such a burner are needed, and even less time if a re-radiator panel is positioned above the moving hangers to receive the energy that radiates upwardly between successive hangers and re-raidate that energy downwardly.

FIGS. 5 and 6 show a particularly desirable automatic igniter construction fitted into aheater of the type illustrated in the parent patents. A standard combination 500 of spark rod 501, ground rod 502 and flame-checking rod 503 is mounted so that the rods are generally parallel to and about 1/16 inch above the outer face 505 of the porous refractory panel 340. Below the opposite face of the panel underneath the rod assembly, the box plenum is provided with a partition 507 that isolates a chamber 509 from the remaining space in the box plenum, and the chamber is fitted with its own supply connector 511 to receive a separate combustion mixture.

The spark rod 501 and flame-checking rod 503 are each housed in two identical insulators 550 which go through aligned openings punched in the top flange 520 of the clamping frame 342 and in the flanges 316 and 314 of plenum 304 as shown in FIG. 5. Ground rod 502 is welded or brazed to flange 520. The ends of rods 501 and 503 projecting out through flange 316 are threaded to each accept a connector 542 which holds them in place and provides a ready connection for necessary wiring.

The construction of FIGS. 5 and 6 is operated to start the burners using a safety check. A separate pilot combustion mixture is first started into chamber 509 and at the same time the spark rod is electrically energized to begin sparking. If the flame rod does not sense a flame within a short period of time, such as 10 to 30 seconds, the flow of combustion mixture can be automatically cut off and the starting sequence must then be manually recycled, preferably after the combustion mixture flow is checked as by purging chamber 509. When the starting sequence causes ignition of the separate combustion mixture, the flame-checking rod 503 senses the ignition and opens the valve that feeds the main combustion mixture into plenum 302 which is then ignited by the flame at chamber 509.

By using a small chamber 509 with a low BTU/hour input for the automatic ignition test, the danger of explosion at ignition is minimized. A chamber volume of about 100 cubic centimeters or less is very effective for this purpose. However, where the pilot chamber 509 extends along the entire edge of a combustion mixture plenum 302, as indicated in FIGS. 5 and 6, the total volume of the pilot chamber is much larger.

The pilot combustion on the radiating surface of the panel contributes to the overall radiation.

The spacing of the rod assembly from the refractory panel is preferably kept very small so that the rods do not interfere with placing the radiating surface close to the material being irradiated, such as a moving textile web that is being dried. Becuase the effectiveness of the heater increases when brought close to the material treated, the spacing of the panel from that material is sometimes arranged to be as little as two inches or even less.

FIGS. 7 and 8 show a hot air heat exchanger construction for house heating pursuant to the present invention. Here a cylindrical heat exchanger 800 has a hollow interior 802 in which is received a fibrous panel 804 also of generally cylindrical shape. The panel has an open end 806 clamped to a mounting plate 808 as by means of a rib 810 formed or welded on the plate and around which the panel end is squeezed by a split sheet metal strap 812 whose ends can be pulled together by a tightening screw 814.

Before the panel is fitted in place a partition disc 820, held on a tubular support 822 having an externally threaded extension 824 is mounted on mounting plate 808 which has a threaded aperture 826 that threadedly receives the threaded extension 824.

Partition disc 820 has its periphery located just above the edge of rib 810, to define a marginal slot 830 for discharge of a sealing gas stream through the marginal portion of the panel 804. An inlet nipple 832 provides for the delivery of the sealing gas stream to the sealing plenum 840 below partition disc 820. Extension 824 provides for the supply of combustion mixture to the plenum 850 above the partition disc.

Strap 812 is also shown as carrying a ring of outwardly-extending ears 842 that help retain a mass of insulation packing 844 fitted around the open end of panel 804 when mounting plate 808 is brought into engagement with the mouth 846 of heat exchanger 800. some of those ears are also perforated to receive an ignition and test assembly 860 shown in the form of a series of ceramic tubes 862 each having an enlarged head 865 threaded into aligned openings in the mounting plate. Through the passageway in each ceramic tube there penetrates a rod 867 having a disc-shaped inner end 870 and staked as at 872 so that it is appropriately located with respect to the ceramic tube. A washer 874 can be slipped over each rod before it is inserted in the ceramic tube, to furnish better positional coaction with the tube and the staking. The outer edge of each rod can be threadedly engaged to a mounting tip 876.

The discs 870 of each rod are arranged so that they are in edge-to-edge opposition suitable for sparking and for flame detection, as described in connection with FIGS. 5 and 6.

The outside of heat exchanger 800 can be located in the circulating air plenum of a standard house heater, or if desired, in a water tank containing water to be heated. This heat exchanger can be made of metal or even of glass, borosilicate glass being particularly suited when the heat exchanger is used to heat water. Water to be heated in this way can be colored with dyes for example, to better absorb radiant energy transmitted through a transparent heat exchanger. Metal heat exchangers are desirably ribbed to increase their effective surface area and thus increase their heat transfer to surrounding air or the like.

Thus the hollow interior 802 can be fitted with a coil of glass or metal tubing through which water is circulated to supply domestic hot water heating radiators. The tubing can also be extended up through the duct from which combusted burner gases are discharged to abstract heat from those gases. By arranging for the water to first flow through the tubing in the discharge duct and then through the irradiation zone 802, the water is efficiently preheated and the discharged gases cooled to as low as 180° F. or even lower. Such a low exhaust temperature is a measure of the high thermal efficiency thus, attainable, and is partly due to the fact that the temperature of the combustion mixture where it burns on the outside face of fibrous matrix is about 1000° F. cooler than the combustion temperature reached without the help of the matrix. Also very little excess air is used with the burners of the present invention. An entire burner and heat-exchange assembly using the so-modified FIG. 7 need only be about one meter tall to supply the heat and domestic hot water for a three-bedroom home. Where such a home is heated by hot air, the tubing carrying the heated water can be run through the hot air plenum of a hot air distribution assembly to heat the air thus circulated through the home.

The water circulated in the tubing can be mixed with a little ethylene glycol or the like to avoid freezing and to increase its boiling point.

A gas exhaust at very low temperature might not create sufficient draft when merely discharged into a chimney flue. However, the combustion mixture of the present invention is supplied to its burner under a few inches of water column pressure above atmospheric, and after burning leaves irradiation zone 802 at a small superatmospheric pressure that helps create a chimney draft. Additionally the blower used to deliver the combustion mixture to the burner can also have a tap that blows some excess air up the chimney flue to help draw the combusted gas up the flue.

At very low gas discharge temperatures, it is possible for moisture to condense out from the gas discharge. Such condensate can be permitted to run to the sewer.

Another feature of the present invention is the ability to use an inert or reducing gas to seal the combustion mixture on its way through the porous refractory panel. Thus the sealing gas can contribute to make the burnt combustion mixture provide an atmosphere of exceedingly low oxygen content, or even of strongly reducing ability as, for example, by reason of a significant hydrogen content.

FIG. 9 shows an annealing tunnel furnace 900 having upper and lower radiant heaters 902, 904 facing each other and held in fixed relation by side blocks 906 of thermal insulation. A wire mesh conveyor 908 is arranged to slide through the furnace interior to carry workpieces that are to be annealed or brazed. A strip curtain 910 closes off the entrance to the furnace, above the conveyor. The portion of the entrance below the conveyor is shown as closed by a one-piece wall 912.

The heaters 902, 904 are operated in the manner described above, except that the sealing gas streams, indicated by arrows 920, can be cracked ammonia, or a propane-nitrogen mixture, or pure propane or the like. With such sealing gases, it is preferable to adjust the combustion mixtures so that they have little or no surplus oxygen. The furnace interior then becomes a very effective reducing atmosphere that will prevent oxidation of the workpieces and even reduce any oxidation present on those pieces when they are introduced into the furnace. Notwithstanding the strongly reducing character of the furnace interior, the burning of the combustion mixture takes place very effectively to provide radiation at temperatures at least as high as red heat.

For high heat output from the furnace, the workpieces should be arranged to absorb larger proportions of the infra-red energy, as by packing them very close together in the conveyer 908, or by arranging for a workpiece to be a continuous length of material that spans the entire width of the burner faces.

FIG. 10 illustrates the manufacture of corrugated board 1010 from a corrugated core sheet 1012, a lower face sheet 1014, and an upper face sheet 1016. Corrugating rollers 1041, 1042 corrugate the core sheet 1012 where these rollers mesh, and roller 1041 carries the corrugated sheet past an applicator roll 1046 that applies adhesive to the lower edge of each corrugation. Roller 1041 also presses the thus coated core sheet against the lower face sheet 1014 which is supported by a backing roller 1051.

Face sheet 1014 with the corrugated core sheet adhered to it moves to the right as shown in this figure, carrying the top of the core sheet past a second applicator roll 1047 which applies adhesive to the top edge of each corrugation. This assembly then is covered by the top face sheet 1016 introduced against the adhesive-coated corrugation after the lower face sheet is pressed at roller 1051, so that the adhesion of the top sheet is best reinforced by the application of heat.

To this end a burner 1000 is shown as held above the face sheet just down-stream of roller 1060, firing downwardly onto the face sheet. Only a few seconds exposure to such heating will set the top face adhesive. Heating can similarly be provided for the lower face sheet if desired. Also the freshly assembled sheets can be gripped by continuous conveyor belts pressing against one or both face sheets to more securely keep the sheets pressed as they advance to the heater and are withdrawn from it.

Burner 1000 is shown as provided with an electrically lit gas pilot light more fully illustrated in U.S. Pat. No. 4,272,238, but it can also be equipped with re-radiation and/or confining boards as in FIG. 18 of U.S. Ser. No. 186,491. It is also helpful to have an additional burner heating the lower face of the assembled corrugated board, as well as further burners preheating the lower face of sheet 1016 as well as the upper face of sheet 1014 just before these sheets reach the feed positions shown in FIG. 10. Of particular help is the orientation of the burner so that the hot combusted gases they generate become trapped in the corrugations and thus continue to supply heat after the corrugated sheet leaves the burner zone. Thus, lower sheet 1014 can be fed upwardly rather than laterally to roller 1051, and an upwardly facing burner can be mounted under the corrugated sheet 1012 where it is carried by corrugating roll 1041 toward roller 1051.

The infra-red energy radiated by ceramic mat burners has a very high power density. It can, for example, cure a polymerizable silicone coating with as little as 5 seconds of radiation. It is also very effective for drying wet webs of paper or the like without the help of any steam-heated rolls.

The apparataus of FIG. 11 has a series of rows of downwardly-facing burners, three rows of which are shown at 1101, 1102 and 1103. A web of wet paper 1110 makes a series of passes at 1111, 1112 and 1113 below the faces of the burners, with the help of reversing rolls 1121, 1122, 1123 and 1124. The paper can then be wound up, or if further drying is needed can be exposed to additional burners or looped over steam cans or other drying equipment. If desired, all or some of the reversing rolls 1121, 1124 can be internally heated as by steam or other fluid, to make the drying apparatus more compact.

Each row of burners has a set of relatively small side-by-side individual burners 1130 similar to the burner of FIG. 5 of U.S. Ser.No. 186,491. As shown in FIG. 12, each burner 1130 has a generally rectangular metal body 1132 of metal like aluminum that conducts heat very well, and with a wall thickness of about ⅛ inch so that it is thick enough to effectively conduct away excessive heat. In FIG. 12 the burner has a combustion mixture deflector plate 1134 supported by posts 1135 secured to the plate and to the back wall 1136 of the burner body. The burner body, plate, and posts are preferably brazed together, as by the molten fluxc dip brazing technique referred to in U.S. Pat. No. 4,272,238.

A single insulation block or pad can cover the backs of an entire row of burners, if desired, or can cover a single back or any other number of adjacent backs.

The burner sides 1155 that are aligned to make the leading the trailing burner edges across which the paper 1110 moves, are shown in FIGS. 12 and 13 as fitted with insulation blocks 1157 that are molded into angularly related flanges 1158 and 1159. Flanges 1158 are clamped against sides 1155 with the help of posts 1160 similar to posts 1135 that are only secured to the burner side walls. Insulation flanges 1159 flare outwardly from the burner faces, preferably at an angle of about 60 to 80 degrees from the vertical. The lower face 1163 of these flaring flanges can have its surface area effectively increased as by a succession of adjacent grooves 1161. The width of flanges 1159 is preferably from about ⅓ to about ½ the width of the burners, in order to take full advantage of the heating effects of the hot combustion gases discharging from the burner faces when the burners are operating.

As shown in FIGS. 11, 12 and 13, the hot combustion gases are kept by thermal deflectors 1162 from escaping over the free edges of the burner walls 1164 at the ends of each row. Deflectors 1162 can be mounted to walls 1164 the same way blocks 1157 are mounted, but the deflectors preferably extend downwardly lower than the bottom edges of blocks 1157, to a level below the path of the paper 1110. The hot combustion gases rise and will accordingly flow upwardly around the bottom edges of blocks 1157, as shown by arrows 1165.

FIG. 11 also shows exhaust ducts 1168 that collect the hot combustion gases which can then be used as a heat source for other operations or to pass through rolls 1121–1124 to heat them. Ducts 1168 can be provided with baffles 1169 that direct the hot gases over a few more inches of the paper 1110 before those gases are withdrawn.

Each individual burner of a row can have its own feed trimming valve 1170 that can be adjusted to offset uneven heating effects that may be caused by differences in the porosities of the matrix faces of adjacent burners. The burners in each row can be mounted with their adjacent sides in direct contact, as in FIG. 5 of U.S. Ser. No. 186,491, but preferably a compressible pad 1172 of thermally resistant material such as ceramic fibers is fitted between adjacent burners in FIG. 13. Such a pad about ⅜ inch thick compressed to half that thickness does not make too much of a gap in the incandescent surface defined by the burner faces, and it also helps to keep the burner-to-burner joints plugged against the leakage of hot combustion gases as a result of thermal expansion during operation.

The gaps between individual burners of a row can have their radiation interrupting effects reduced by shaping the burners so that these gaps extend at an angle with respect to the direction of paper movement. This will spread the radiation interrupting effect over wider portions of the paper, or even over the entire width of the paper.

The radiation interruption at the gaps is also reduced by a tapered thickness reduction at the free edges of the burner side walls, as shown in FIG. 31 of U.S. Ser. No. 94,901. The burner matrixes 1176 are sufficiently resilient that they can be squeezed into place against such tapered walls and thus effectively reduce the width of the outer lip of the wall to about 1/16 inch even though the balance of the wall is about ⅛ inch thick.

As pointed out above, the movement of the hot combustion gases over the flared surfaces 1160 heats up those surfaces to temperatures that come close to the temperature of the incandescent burner faces, particularly when those surfaces are of low density thermal insulation. The resulting high temperature of surfaces 1163 will accordingly generate additional infra-red radiation that helps dry the paper 1110. This additional drying is provided without increasing the amount of fuel used, so that the fuel efficiency is greatly improved.

FIGS. 12 and 13 further show the provision of a burner igniter in the form of a spark-fired pilot flame director 1178 as in FIG. 10. This can be provided with its own flame-detecting rod 1179, or if desired an ultraviolet detector 1180 can be fitted at the opposite end of a row of burners, to detect burner operation when the burners are being lit, and automatically shut down the gas feed if the burners do not ignite or if they should be inadvertently extinguished.

The grooving 1161 preferably has a depth of at least about ⅛ inch, and this depth can be as much ½ inch. The grooving effectively increases the surface 1161 as compared to a perfectly flat surface, and an increase of at least about 50% is desired. To this end the profile of the grooves can be triangular, rectangular, sinusoidal, or have any other shape.

The combustion gases discharging from the far ends of the surface 1161 can still be sufficiently hot to warrant their use as for heating a further radiating surface. Thus, those gases can be sucked through a porous insulator such as a ceramic fiber matrix positioned as an outer extension of surfaces 1161. The resulting relatively forceful flow of still hot gas through the porous matrix heats it up more effectively than the surface 1161 is heated, so that the heated face of the porous ceramic fiber matrix can contribute a significant amount of additional infra-red radiation.

The use of the surfaces such as 1161, with or without the foregoing extensions improves the operation of any fuel-fired burner that generates hot combustion gases. Thus burners 1130 can be replaced by ceramic tile burners, metal screen burners, or ceramic cup type burners, or even direct flame burners, and in each case the burner operation shows a similar improvement.

The individual burners 1130 in the assembly shown in FIG. 13 are preferably dimensioned so that different burners or groups of burners 1130 can be operated. In this way all the burners can be operated to heat a web 1110 of maximum width, and smaller numbers of burners can be operated to heat webs of smaller widths. Shutting down one or more burners has been generally effected with minimum construction cost by shutting off the flow of the propane or other combustible gas to those burners while permitting continued flow to those burners of the air otherwise mixed with that combustible gas to make the combustion mixture.

The same combustible gas shut-off has been used for emergency shut-downs, as for example, when the web stops advancing and it is necessary to keep the stopped web from becoming charred by the burners. However, such gas shut-offs are not prompt enough for certain stoppages such as when the web is a paper being printed at high speed with ink that requires heat treatment to dry rapidly. Such printing machines can be stopped in less than a second or two when there is an emergency such as tearing of the paper web. For such very abrupt stopping, it is preferred to rapidly trip shut the air supply to the mixer. This immediately stops the flow of combustion mixture and extinguishes the burner. The ceramic fiber matrix on which the combustion had been taking place, prevents flash back of the flame toward the mixing equipment and thus prevents damage.

The standard mixing equipment includes a so-called zero-pressure regulator which is designed to prevent flow of gas to the burner when the flow of air is interrupted, but when other types of mixing equipment is used, it is desirable to have the emergency shut-down at both the air flow and the gas flow. Electrically-operated solenoid valves made it simple to simultaneously and very abruptly shut off both those flows.

Such simultaneous shut-offs may also be desirable even when zero-pressure regulators are used for mixing. The use of a solenoid-operated gas valve is very helpful when an installation contains several burners some of which are to be selectively kept out of use on occasion. Also, the closing of the gas valve permits simpler cycling of the burner safety system for relighting.

It is generally desirable to have the burners located below the work being irradiated inasmuch as the burner body is then not subjected to so much heating and the rising hot combustion products remain longer in contact with the work thus increasing the heating effect. In some cases, however, the only practical installation has the burner firing face down over the work.

FIG. 14 shows an installation of this type in a portion of a paper-making machine preceding all or most of the steam can driers. A paper web 810 120 inches wide is here illustrated as moving in the direction of arrow 801 between two rollers 805 and 806. Over the web is positioned a burner 800 firing face down. To assist in the removal of moist air from adjacent the burner and thus speed the drying action, a blower 814 is arranged to blow a stream of low-humidity air between the burner and the web, as indicated by the arrows 821. This stream moves longitudinally of the web and transversely of the burner, countercurrent to the paper movement, and a baffle 829 can be provided to help deflect the stream away from the web after the air in it has become heavily laden with moisture.

Another stream of dry air 822 can be used to flow in the opposite direction along the web to further help remove from adjacent the web the moisture vaporized by the heat treatment. The burner and blower assembly can be placed under the web 810 facing upwardly, or two such assemblies can be used, one facing down from above and the other facing up from below. Instead of or in addition to blowing air against the web, suction can be used to help suck some or all of the hot combustion products and vapors along and away from the web. Air jets can also be used to move the combustion products.

Figure 15:
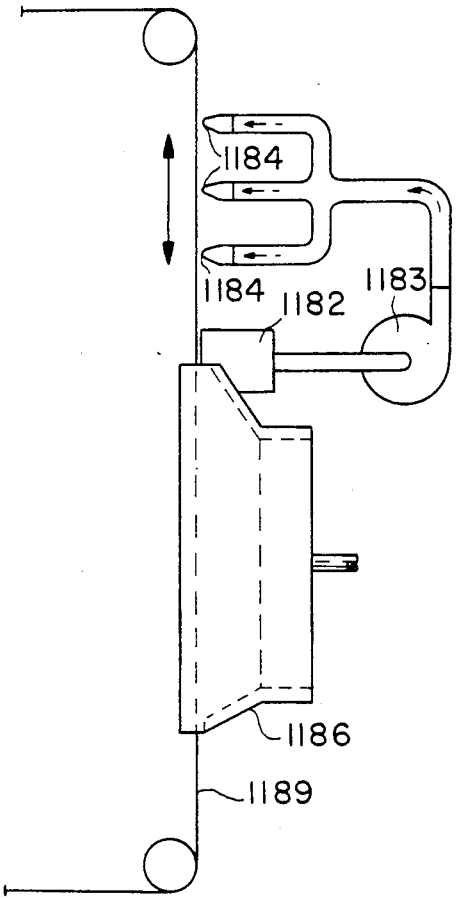

FIG. 15 illustrates a modified arrangement used to heat paper or other webs that are moving vertically rather than horizontally. In such an orientation the hot combustion gases need not flow downwardly out of the bottom edges 1186 of the burner units, so that those edges can be relatively short lengths of insulation that are horizontal or only mildly flared—about 20 to 30 degrees down from the horizontal. Those lower edges can also be brought relatively close to the moving web 1189—about ½ inch—to limit the ingress of ambient relatively cool air into the hot combustion gases.

To improve the heating effect of the hot combustion gases they are withdrawn through a top exhaust duct 1182 and propelled by a blower 1183 to jets 1184 from which those hot gases are jetted against the moving web 1189. This breaks up the boundary layer barrier of steam or the like that can be present on the web.

The burners of the present invention dry paper with particular effectiveness. The radiation they emit is about as efficient in removing the last bit of excess water from an almost bone-dry paper, as it is in removing the first bit of water from a very moist sheet, and this permits an unexpectedly sharp drop in the bulk of a paper dryer.

However, textile webs of cotton, wool, polyester, rayon, polypropylene, dacron and the like, or mixtures of such fibers, as well as plastic films are also very efficiently dried or cured with such burners.

A guide, such as plate 1129 in FIG. 11, can be used to assist with the threading of web 1110 past the burners in preparation for a drying run.

Infra-red radiation is also highly effective for preheating plastic sheets to prepare them for pressure or suction forming. Thus, a continuous sheet of polystyrene or the like can be moved in steps toward a cutting and molding press that stamps out successive suitably dimensioned portions and successively molds them into shape, with the sheet subjected to any of the irradiation arrangements described above immediately before it reaches the cutting and molding press. By making the irradiation zone equal in sheet travel length to the length of each sheet advancing step, uniform pre-heating of the sheet is obtained.

Where it is necessary to limit the amount of pre-heating so that an incandescent radiator surface must be substantially smaller than the length of an advancing step, the advancing sheet can be arranged to first advance at an uninterrupted uniform rate past a short irradiation zone, and to then be carried as by a tenter frame assembly that permits stepwise feeding to the cutting and molding press.

In the event the preheating tends to cause the plastic sheet to shrink in width or length, the heated sheet can be placed under tension, transversely or longitudinally or both. To this end a tenter frame type step advancing means can be provided with weighting rolls to apply longitudinal tension to loops of the sheet, and can additionally or alternatively be fitted with clamps that grip the side edges of the sheet and in this way apply transverse tension.

Burning a gaseous hydrocarbon fuel at the surface of a ceramic fiber matrix has been found to yield exceptionally small amounts of carbon monoxide and nitrogen oxides. Burners of this type are accordingly highly suited for industrial and domestic space heating by merely facing the incandescent matrix toward the space and the people to be warmed. The gaseous combustion products leaving the matrix can thus be permitted to enter and diffuse through the space being warmed, without increasing the carbon monoxide and nitrogen oxide content of the air in the space as much as it would be increased by open flames of conventional fuel-fired heaters or even cooking ranges. A matrix type space heater is accordingly very inexpensively installed. Since it is also a very effective generator of infra-red energy and warms both through such infra-red generation as well as by the heating effects of its hot combustion products, it also makes a highly efficient installation.

If desired, such a space heater can be equipped with a hood that collects its combustion products as they rise from a laterally directed vertical matrix face, for example, and vents them through a chimney or stack. Inasmuch as matrix combustion is essentially stoichiometric there is essentially no excess air in those combustion products so that the cross-sectional area of the stack or chimney can be quite small.

Figure 16:
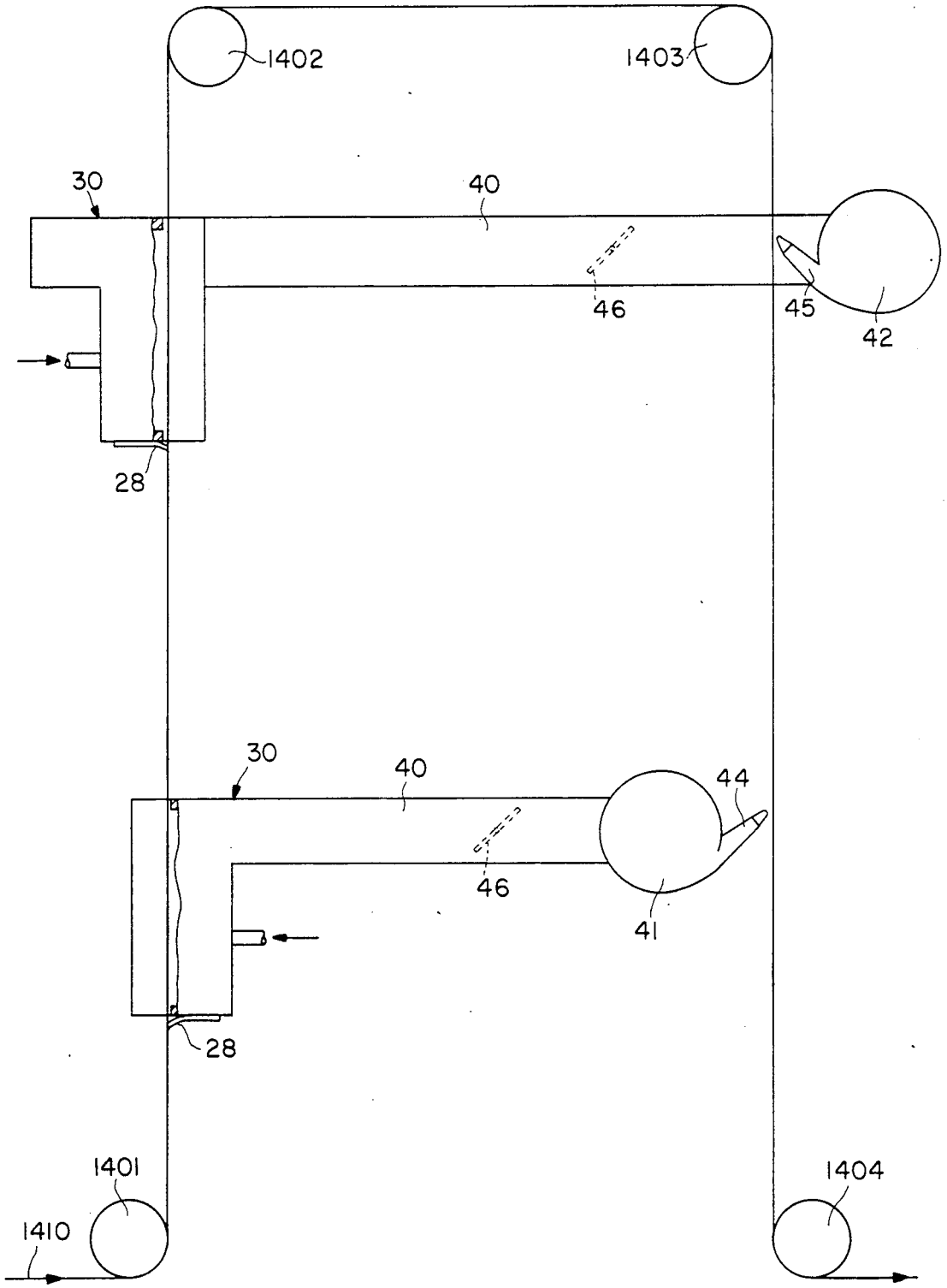

The pre-dryer of FIG. 16 has four rolls 1401, 1402, 1403 and 1404 that guide a freshly dyed textile web 1410 to a set of steam-heated drying rolls (not illustrated) where the final drying is effected. Between rolls 1401 and 1402 the web moves upwardly and in this travel each of its faces is irradiated by a heater assembly 30 illustrated in FIG. 1 of U.S. Ser. No. 186,491. Each of these assemblies has a draw-off conduit 40 through which gaseous combustion products that are still quite hot, are withdrawn. These conduits 40 lead to the intakes of blowers 41, 42 which have their discharge outlets 44, 45 directed to rapidly blow the discharged gases against the textile web as it descends between rolls 1403 and 1404.

The heater assemblies 30 can each have a scoop 28 that not only improves the drying action but also helps keep the web from fluttering as it moves upwardly. Such fluttering generally takes place, sometimes to a dangerous degree, in pre-dryers that have a substantial span between rollers 1401 and 1402.

The discharges of blowers 41 and 42 are preferably arranged to propel against the textile web, streams of hot gas at a velocity of at least about 10 linear feet per second. The velocity brings the hot streams in very good heat exchange relation with the web. The heat exchange relation is also improve by inclining the hot streams about 30 to about 60 degrees upwardly. An enclosure can be provided around the downwardly moving textile web to help confine the blown streams near that web as they move upwardly alongside it.

FIG. 16 also shows an adjustment device in the form of a damper 46 in conduits 40. This damper can be opened or closed to provide the optimum drying effect. Thus the re-radiator 26 of assembly 30 will supply the best heating when it is at the highest possible temperature, and damper 46 can be adjusted while the surface temperature of the re-radiator is measured with a pyrometer. Opening the damper too wide can increase the suction in the discharge plenum 35 so much as to draw ambient air in through the re-radiation and this will cool down the re-radiator surface. On the other hand closing the damper too much reduces the volume of hot gas blown through the pump outlet. Optimum drying is generally effected when the damper is as far open as it can be set and still keep the re-radiator surface very hot.

Only one drying assembly can be used in the apparatus of FIG. 16, or conversely a large number of them can be used so that little or no steam roll drying is needed.

As shown in FIG. 18 the infra-red radiating burner 1510 can have a Bernouilli airfoil floating dryer 1601 preceding it in the path through which web 1502 moves during the drying. Dryer 1601 is an elongated box that can be generally rectangular in cross-section and provided with a very narrow slot 1610 through which a stream of heated gas such as air is expelled at a velocity of ten to fourteen thousand linear feet per minute. The slot lips 1611, 1612 are shaped to divert the expelled stream at an acute angle, about 30 to 60 degrees away from the box wall 1613 that forms upstream lip 1612. At such stream velocities the stream moves along the surface of substrate 1502 and develops Bernouilli forces that urge the substrate toward, but also hold it short a fraction of an inch from wall 1613. This type of gas flow is rather turbulent and very effectively subjects the substrate to the drying action of that stream.

The gas stream for dryer 1601 is preferably taken from the hot combustion products discharged by burner 1510, as by enclosing the combined dryer structure in a housing into which all the hot gases flow, and from which a blower blows some of those gases into the interior of the box of dryer 1601.

Dryer 1601 is shown as directing its discharged stream counter-current to the movement of the substrate but can alternatively discharge its drying stream in the opposite direction so that it moves co-current with the substrate. Moreover, two or more such Bernouilli airfoil dryers can be fitted to the leading wall of burner 1510, and these can have their gas streams all directed counter-current, or all co-current, or some one way and the remainder the other.

Another Bernouilli airfoil dryer 1602 is shown as fitted to the exit end of dryer 1510 and can operate like the preceding dryer or dryers 1601. Also, the re-radiator panel 1560 can be eliminated along with its mounting structure, so that the exit Bernouilli airfoil dryer 1608 directly follows irradiating burner 1510. The Bernouilli airfoil drying combination does not require the build-up of any significant depth of hot gases under the burner matrix or under the re-radiation panel, if used.

A preferred modification of the construction of FIG. 18 is illustrated in FIG. 19. Here a set of Bernouilli airfoil guides 1603, 1604 are secured to the respective upstream and downstream ends of a burner combination 1605 containing four burners 1610, 1611, 1612 and 1613. Centrally of the burners is an exhaust gas flow-through box 1615 whose lower wall is a porous re-radiator panel 1616 corresponding to panel 414 of FIG. 4.

Airfoils 1603, 1604 are arranged to direct their discharged air streams towards the burners adjacent to them, so that they not only guide the web 1502 but also flush toward the exhaust gas flow-through box all of the hot burner combustion products along with whatever vapors are expelled from the web by the heating action. In many cases the web contains combustible solvents or the like when it enters the apparatus, and those contents are vaporized by the heating action. These vapors are kept from significant leakage to the atmosphere, and are swept toward box 1615. When those vapors are oxidizable they will be oxidized, generally by the time they reach panel 1616 so that only oxidation products are discharged from that box. The heat content of the thus-discharged products is recovered in a heat exchanger 1617 where they heat up an incoming stream of fresh air blown through by blower 1618. The resulting heated air is supplied to the airfoils 1603, 1604, and thus supplies oxygen for the oxidizing process as well as any additional heating of the web.

Skirts 1619 depending from the side edges of the burner combination 1605 help keep the airfoil discharges and burner discharges from escaping at the side edges of the web. As in the construction of FIG. 3, panel 1616 can be impregnated with oxidation catalysts such as platinum or palladium to assist with the oxidation of vapors.

FIG. 20 shows a heat-treating apparatus 10 for drying porous fabrics such as non-felted open webs of long-fibered thin sheets. Such a web 12 is delivered from a web-forming station, for example, is received on the upper run 14 of an endless conveyor belt that carries the web through a heating station defined by a burner assembly 18. Assembly 18 is a collection of gas-fired burners 20, 21, 22, 23, 24, 25, 26, 27, 28 and 29, each extending across the width of the web 12 facing downwardly to heat the web as it is carried by the conveyor. The burners can be built along the lines shown in U.S. Ser. No. 186,491, but are mounted in pairs each pair being spaced from the next to provide gaps 31 that also extend the width of the web. A set of idler rolls 33 helps support the conveyor run 14, and as shown these rolls are preferably located where they do not receive the full blast of the infra-red energy generated by the burners.

Conveyor 16 is porous and is made of strands that withstand temperatures up to 400° F. or 450° F. A metal mesh conveyor belt can be used, but meshes of thermally resistant cords are particularly desirable since they do not carry off so much heat and the cords themselves are somewhat transmissive of infra-red energy. Also a fabric mesh conveyor is very light in weight and is much simpler to operate. Belt thickness as little as 1 millimeter are all that is needed. Aramid, qiana and other temperature—resistant fibers, tire cord grade Kevlar fibers for example, make good conveyor cords, and even nylon fibers can be used where they are not heated above about 250° F.

The conveyor face that receives web 12 is preferably coated with poly(tetrafluoroethylene) to minimize the danger of the web sticking to the upper run particularly when the web arrives in wet condition.

A series of suction boxes 41, 42, 43, 44, 45 and 46 is placed below the conveyor run 14, with their suction mouths 39 very close to or even contacting the lower face of the conveyor there. Mouths can be made of poly(tetrafluoroethylene) to minimize friction. The boxes are connected to a suction manifold 37 at one or both sides of the apparatus, and these manifolds are in turn connected to a suction blower. Between the suction boxes there is fitted infra-red re-radiators which can merely be sheets 44 of thermal insulation opaque to infra-red. The upper surface of these sheets have some of the burners' infra-red energy impinged on them through the porosities in the web and in the conveyor, and those surfaces are thus heated and themselves radiate infra-red energy. That re-radiated infra-red energy helps supply additional heat to the bottom of web 12.

The fibers of which web 12 is made, may also be partly transparent to the infra-red generation, and thus permit more infra-red energy to reach the re-radiators.

The application of suction to the interiors of the suction boxes causes them to suck in gas through the porosities in the web and in the conveyor. Some of the very hot gaseous combustion products discharged by the burners are thus drawn through the web to further increase the heating effect. Also where the web is wet with water or contains any other volatilizable material, the movement of the sucked gases through the web greatly increases the removal of such material.

The gaps 31 between burner pairs permit the dilution of the hot combustion products with ambient air from between the burner pairs, so that mixtures of these two gases can be sucked through the web. Such mixtures can have temperatures much lower than the undiluted combustion gases, and some webs can be damaged by such undiluted gases. At the gaps the burners can carry adjusting devices such as slides 48 that can be shifted to cover or partially cover the gaps.

The degree of suction at the suction box mouths can be selected between about 1 and about 200 inches of water column, and the burner mouths sized to cause all or only some of the hot combustion gases to be sucked through the web, with or without dilution by ambient air. To help assure that all of those hot combustion gases are available to be sucked through the web, the burners can be fitted with end skirts 50 that extend downwardly more than the side walls 52. This causes the hot combustion gases to build up under the burner face until they spill out below the bottoms of the side walls.

The conveyor strands or cords preferably provide spaces of about 1 to about 4 millimeters between them, and such openings will not have any significant effect on the manner in which the web is supported by the conveyor. The side margins 56 of the conveyor can be made with less or no inter-strand spacing, and can be completely coated to strengthen it against tearing. An impervious edge boundary so provided also helps confine the boundaries of the suction effects and reduces suction losses.

The assembly of FIG. 20 can be mounted in a framework 60 only about 18 feet long, and does a drying job about as effective as 15 steam-heated drying rolls each 5 feet in diameter. Shorter burner assemblies can be used if less drying is desired.

The individual burners 20, 21, etc. can be of the air-seal type or of the non-air-seal type, both described in U.S. Ser. No. 186,491. Air-seal burners discharge significant amounts of air around the hot combustion gases, so that those gases are cooled somewhat by the discharged air before they flow out past side-walls 52. The air-seal flow can, if desired, be increased to the point that no additional ambient air is needed at gaps 31.

The burners are shown as of the ceramic fiber type, that is they have a porous felted ceramic fiber mat through the thickness of which is passed the gas-air combustion mixture to be burned, and the mixture burns as it emerges form the mat. This burning heats to incandescence the fibers at the face from which the combustion mixture emerges, and these incandescent fibers generate the infra-red energy which is so effective. However, other types of gas-fired infra-red burners can also be used, such as those that have ceramic plates heated to incandescence by gas flames, or those that have metal screening heated to incandescence. So-called catalytic burners are not desirable inasmuch as they are intended for operation at temperatures too low to do a good job of heating webs.

Assembly 10 may also be provided with a hood 66 that can be fitted with a blower to collect and remove combustion products and vapors. The web path in assembly 10 can be tilted rather than horizontal, so that the web moves in a direction inclined upwardly or downwardly, or even perfectly vertical.

The construction of FIG. 22 is used to help dry one or both edges of a paper web. When paper dryers are fed with undryed paper wider than preferred, the outermost few inches of the edges 1912 of the paper generally do not dry sufficiently. According to the present invention narrow burners 1900 are placed over and/or under one or both edges 1912 to more closely equalize the drying in such an installation.

In FIG. 22 two burners 1900 are shown as held on an outer carry plate 1902 that is pivoted from overhead pin 1904 by means of an elongated beam 1906, so that the burners can be pivotally retracted from the illustrated position, to simplify the threading of the paper web 1910 through the dryer. The burners are easily restored to their illustrative operative position where they are latched in place.

The fuel supply conduits to the burners 1900 are made flexible to yield with the foregoing pivotal action or the conduits can be provided with swivel joints, the swivel axes of which are aligned with pin 1904, so that the portions of the conduits secured to the burners can pivot with the burners. Where the burners have air-seal margins, a blower can be mounted on one of the burners 1900 or on carry plate 1902 or beam 1906, to supply a stream of air for the air-seals, and if desired all the air for the combustion mixtures as well.

Carry plate 1902 is also shown as holding a pad 1916 of thermal insulation such as one made of felted ceramic fibers. This pad is not needed, but if used improves the drying efficiency by acting as an absorber and re-radiator of infra-red rays. It absorbs infra-red radiation emanating from the faces of burners 1900 and its surface 1918 becomes quite hot in doing so. This hot surface re-radiates infra-red energy to the surfaces of paper edge 1912 without losing much heat by conduction to the relatively cool carry plate 1902. Pad 1916 can be grooved as shown at 1922 to permit the paper edge to completely block direct radiation from one burner face to the other.

Passageways 1931, 1932 can be provided through the carry plate 1902 and through the pad 1916, so that the faces of the burners can be observed and thus monitored to assure proper operation. Automatic monitoring can be arranged by fitting a light or ultra-violet sensor to the passageways, and connecting them to automatically shut off all fuel flow to a burner whenever the burner face is not lit. For lighting the burners electric ignition such as shown in U.S. Pat. No. 4,157,155 can be used or, if desired, pilot flames with manual controls to override the sensors.

Groove 1922 can be flared to better permit radiation to reach the extreme margin of the paper. Burners 1900 can also be equipped with scoops and/or extensive re-radiator panels as in U.S. Ser. No. 186,491 and/or confining boards such as 1546 in FIG. 18.

Where two burners 1900 are used at one edge of the paper, they can be located face-to-face, or they can be offset so that they do not radiate directly at each other in the event the paper web 1910 tears or its edge 1912 is damaged or missing. Such direct counter-radiation can rapidly damage the burner faces, particularly if those faces are ceramic fiber mats, and to guard against such damage a photoelectric web edge detector can be located upstream from the burners and connected to shut off the flow of fuel to one or both burners when the edge 1912 is missing from the paper web.

A similar safeguard can be used to extinguish both burners when the paper web 1910 stops or slows down excessively. Even relatively low-temperature operation of the burners can rapidly scorch a stopped paper web.

Either or both burners 1900 can also be equipped with re-radiator panels. Where so equipped the assembly of one burner with its re-radiators can be placed directly opposite a similar second assembly but with each burner directly facing the re-radiator panel portion of the opposing assembly.

Figure 17:
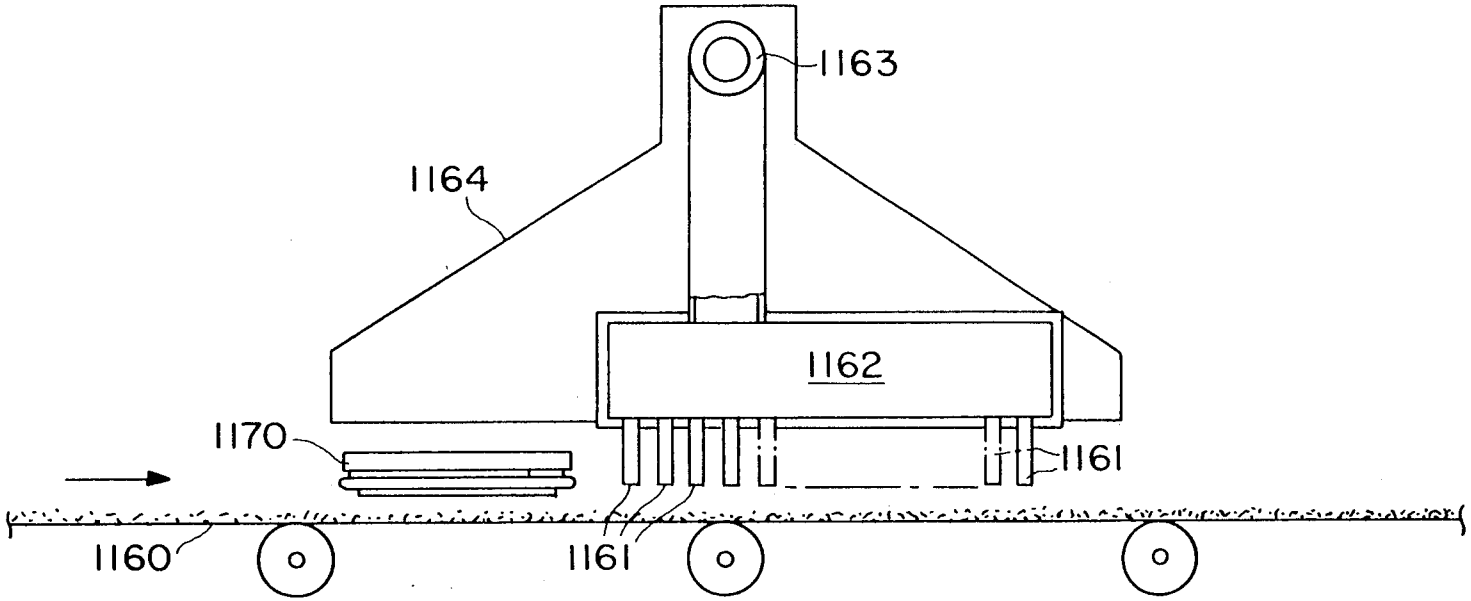

FIG. 17 also illustrates a desirable heating and drying combination of the present invention. Here a conveyor 1160, which can be of the belt or vibratory type, carries a layer of particles that are to be dried and/or heated. The layer first passes under infra-red generator 1170 which can have any of the gas-fired constructions described above or in the parent applications or can be of the ceramic tile or wire mesh type. After the infra-red generator, the particles pass under an array of tubes 1161 through which there is projected downwardly, spaced streams of heated gas. This gas comes from a manifold 1162 into which it is blown by a blower 1163. The intake of the blower is connected to two hoods, one shown at 1164 as extending along one side of burner 1170 and manifold 1162. The other hood extends similarly along the other side of those structures.

Hoods 1164 suck up the hot combustion gases generated by burner 1170, as well as the gases blown out of the bottoms of tubes 1161 after those gases have blown through the layer of particles. These sucked up gases can then be further heated by a burner upstream or downstream of blower 1163, and blown out against the layer of particles. However, if this blown out gas does not have to be as hot as, or hotter than, the hot combustion products from burner 1170, little or no auxiliary heating is needed in the sucking and blowing section. Where the blown gases cool too much in that section, a second burner 1170 can be added in front of the first burner so as to add more infra-red irradiation as well as extra heat for the blown gases.

It is not necessary to seal in the gas collection and recirculation path of the construction of FIG. 17. This simplifies the construction and the sucking in of a little extra air is no significant problem.

Tubes 1161 can have their lower ends tightly or loosely fitted through holes in a horizontally-extending deflector plate. Alternatively a tube construction as in U.S. Pat. No. 4,235,591 can be used with or without the hot gas recycling of that patent. Even the blowing arrangement of U.S. Pat. No. 3,239,863, designed for dust removal, can be used to effectively blow heated gas over substrates to dry them.

FIG. 23 shows a heat-treating arrangement using an air jet arrangement to assist the heating. Here a wet paper web 1650 is passed under a gas-fired infra-red generator 1652 that can be of the air-seal or non-air-seal type and fires face down. To the downstream end of the burner is secured a box 1654, generally rectangular in cross section that can extend the full width of the burner in the direction transverse to the web movement. The downstream end of the box is closed or partially closed by an air jet duct 1656 that can be moved up and down as indicated by the double-headed arrow 1658. The lower end of the jet duct is tapered to a narrow jet nozzle 1660 that fits in and coacts with a downwardly-directed venturi 1662 whose upper end 1664 opens into box 1654, and whose lower end includes a diverter angle 1666 that splits downwardly jetted air into two streams, one directed down and upstream of the web, the other down and downstream of the web.

Box 1654 has its lower wall 1668 perforated and secured to the lower surface of that wall is a re-radiating ceramic fiber panel 1670. That panel can seal against the venturi to close off the bottom of box 1654. The top wall of the box does not reach quite as far as the jet duct 1656, leaving a gap 1672 that can be covered to varying degrees by a slide 1674.

In operation the burner is fired by a combustion mixture fed into it at arrow 1676. The hot combusted gases accumulate below the burner face and move toward the box 1654 as indicated at 1678. Air blown into jet duct 1656 as indicated at 1680 aspirated the gaseous contents of box 1654 out through the venturi 1662, thus lowering the pressure in the box and sucking the hot gaseous combustion products into the box through re-radiator panel 1670. The aspirated box contents are accordingly hot combustion products diluted with some ambient air as determined by the position of slide 1672. The jetted air also mixes with the aspirated air, and this mixture can be further adjusted by raising and lowering the jet ducts. Lowering that duct to its lower limit can bring it in contact with the venturi throat and thus essentially completely block the aspiration.

The direction of web movement can be opposite to that shown in FIG. 23, if desired. Additionally or alternatively a second burner-jet combination can be mounted downstream of the first to supplement the web treatment.

FIG. 24 illustrates a modified drying arrangement 1838 for webs 1802 of paper or textile or the like that are wet with water or other volatilizable liquid. The structure of 1838 includes a gas-fired burner 1858 having a ceramic fiber matrix 1843 the outer face of which is generally parallel to a planar irradiation zone 1844 along which web 1890 is guided by rollers 1839, 1840. The burner holds its matrix 1843 in the vertical plane, and above the burner is a porous re-radiator panel 1860 through which is sucked the hot combusted gas generated by the burner. Suction is applied from the intake 1853 of a blower 1854, and a side inlet 1852 open to a supply of ambient dry air but controlled as by damper 1851, is connected to mix such ambient air with the hot gases sucked through re-radiator 1860.

Blower 1854 propels through outlet 1855 the gases drawn through inlet 1853 and pushes those propelled gases at a pressure of at least 10 psig through a discharge slot 1847 shown as formed by a sheet metal box 1856. The slot 1847 should be about 3 to about 6 millimeters wide and should extend across the entire width of web 1891, so that it delivers a thin air curtain jet of recirculated gas directed at a speed of at least about 10 feet per second along the web surface being irradiated.

The jet should not be discharged more than about 5 millimeters from the web surface, so that the outer wall 1848 of the metal forming the jet should be quite thin—not over about 1 millimeter. This permits that wall to be spaced a few millimeters from the web. The jet can be directed parallel to the web, or it can be directed toward the web by up to about 5 degrees In order to reduce the burbling caused by the venturi effect of the jet, wall 1848 can have a number of small perforations that permit gas to flow at low speed from the interior of the jet forming box into the space 1846 between the web and wall 1848.

Also an additional gas discharge 1845 from blower 1854 can be directed at relatively low speed toward the web from a distance of 1 to 3 millimeters. This causes gas streams to flow both upward and downward along the web, as shown by arrows 1848, 1849. Stream 1848 also helps reduce the mixing effect of the venturi formed by jet 1847. Jet 1847 can alternatively be angled a bit so that it is directed toward the web 1891, rather than parallel to it. Thus box 1856 can be spaced about 5 to about 7 centimeters from the web, with its slot directed about 20° from parallel so that it gradually reaches the web and continues along the web in anessentially laminar flow.

By making the distance from the jet discharge to the upper end of the irradiation zone not over about 50 centimeters, the jetted air curtain will accomplish two results. It will not only rapidly flush away the vapor laden gas layer formed at the web surface by the heating effect of the irradiation, but will also keep its curtain nature and not intermix too much with the combusted gases generated by the burner. The curtain can then be collected in an exhaust box 1859 at the far end of the irradiation zone, and discharged at a location where the vapor it picks up is not returned to the web.

The temperature of the air curtain gas should not be so high as to damage the web. Where the web is paper, that temperature should be not over about 400° F. Some webs made of resin fibers will be damaged if the jet temperature is above 250° F., but high temperature webs such as those made of kevlar can withstand 450° F. jets. The jet temperature is easily controlled by adjusting damper 1851 to mix more or less cold ambient air with the recirculating hot gases.

Burner 1842 is shown as an air-seal type burner as in FIG. 3 with marginal hold-down flanges 1857 holding matrix 1843 in place. A non-air-seal type burner such as that of FIG. 12 can alternatively be used, so that no significant amount of metal is exposed to the combustion zone. Where metal is so exposed at the upper end of the burner, such metal can be covered as by extending panel 1860 downwardly to overlie the metal.

All of the 1838 equipment can be mounted on a single metal channel or plate 1858. Resilient separators as at 1882 can be inserted between adjacent metal structures that are at different temperatures in use, to reduce thermal stresses upon heat-up and cool-down.

Web 1891 can be traversed across the irradiation zone in an upward or downward or even sidewise direction. Several units 1838 can be used to treat a web, either in cascade as in FIG. 20 or in tandem to irradiate both web faces. The units can also be tilted away from the vertical.

Thus as shown in FIG. 25, a web can be threaded up and over a top roller 1888 and then down, to provide two runs 1890, 1892 against each of which an irradiating unit is installed. This triangular web run uses only a single roller 1888 that is not in line with a main set of rollers 1894, 1896, and is therefore desirable. Such a triangular arrangement is also suitable as a modification for the construction of FIG. 16, or for other treatment applications.

The construction of FIG. 24 can be varied as by eliminating the sucking of the hot combusted gases through a porous re-radiator panel. Such a variation is partly illustrated in FIG. 26. Here a web of wet paper 1990 or the like is irradiated by an irradiation unit 1938 that includes a gas-fired infra-red generator 1942 and a re-radiator panel, as well as means for sweeping a stream of gas from a jet discharge 1947 to an outlet 1988. Generator 1942 can be constructed like generator 1842 in FIG. 24, and panel 1960 can be made of porous or non-porous ceramic fiber construction.

The gases emerging from outlet 1988 can be recycled by blowing them through jet 1947, preferably after they are cooled somewhat as by mixing with ambient air. Panel 1960 has its irradiating surface facing web 1990 heated by the hot combusted burner gases that move past that surface toward the outlet 1988.

The ceramic fiber matrixes for the various burner constructions of the present invention are generally long enough to span the entire width of a web that is to be irradiated, even if that web is 200 inches wide in the cross-machine direction. For web widths over about 78 inches, the matrixes are preferably pieced together as described in U.S. Pat. No. 4,224,018.

In the machine direction, the matrixes have generally been relatively short. Thus in an air-seal burner as illustrated in FIG. 3, the matrix might only have 11 inches of its machine-direction span heated to incandescence. The matrix itself could measure a total of about 14 inches in the machine direction, but 3 of those inches are covered by hold-down angles or are devoted to air-seal air discharge. The burners of the present invention preferably provide incandescent spans as large as 15 inches in the machine direction. Where a 15 inch radiant span is provided in a burner such as that of FIG. 3, the overall span of the matrix could be 3 inches greater.

About 1½ to 2 inches of the matrix's machine direction span can be devoted to a pilot compartment as illustrated in FIGS. 5 and 6. Thus in an arrangement of the type illustrated in FIG. 20, each burner can have a two-inch wide pilot combustion compartment extending across the entire cross-machine direction of the burner. A flame monitor can then be mounted at one end of the burner in alignment with the pilot compartment and oriented to respond to incandescence or flame on the matrix portion covering the cross-machine center of the pilot compartment.

The pilot compartment is more conveniently ignited as by the electric ignition of FIGS. 5 and 6, than an entire burner, and the monitor will then serve to make sure the pilot compartment is operating. In the event the monitor fails to show such operation, it automatically shuts down the entire burner, as a safety measure. However, so long as the pilot compartment operates, it can be controlled to always remain operating, whether the burner is turned up to its maximum output, or turned down or out. In such an operation the pilot compartment is arranged to be turned down to provide very little radiation, so that even though it remains operating when the balance of the burner is shut off, it will not ignite a paper web for example that may be stopped facing the operating compartment. When the burner is turned on after being turned off, the pilot compartment which can be kept on all the time will ignite the burner's combustion mixture.

To place a burner in operation, only the pilot compartment need be started, and since the pilot compartment is much smaller than the combustion mixture plenum, the start-up takes less time. Start-up also generally involves a discharge of excess combustion mixture, and such excess is much smaller for the pilot compartment than for the entire burner.

If desired, the pilot compartment can be continually maintained in operation at a very low level, whether the burner itself is turned up high or turned down low. Although this reduces the maximum radiation available from the burner, the burner controls are simplified and interruption delays reduced. Also burners are almost never used at their maximum output, and for a burner with a 15 inch radiant length in the machine direction, a 1.5 inch pilot compartment length in that direction is very minor.

The foregoing modification of FIG. 20 can be further modified as shown in FIG. 27. Here, substrate 2000 being irradiated is not very porous paper, for example, and the irradiating structure 2002 is carried by an encircling frame 2004 the interior of which can be lined with thermal insulation. The frame is open at its top and bottom, and holds a set of four burners 2011, 2012, 2013 and 2014 as well as a set of porous re-radiator panels 2021, 2022, 2023 and 2024. The burners and panels are offset from each other so that burners do not fire at each other in the event the substrate is not in place. Piping supplies combustion mixture and the like, and draws off combustion products through the re-radiator panels, but is not illustrated.

In FIG. 27 the substrate is carried through the frame from left to right, through an entrance slot 2008 and an exit slot 2009. Just before it reaches the exit slot it is subjected to gas jet curtains from jets 2031, 2032 which are directed toward the substrate and about 40 to 50 degrees upstream. This jet curtain treatment keeps the gases in the irradiation zone 2019 from escaping in any significant amounts through exit slot 2009, and can also by the jet action help suck ambient air through that slot from outside frame 2004.

The top and bottom of frame 2004 is completely filled by the burners and re-radiator panels so that the only other opening into the irradiation zone is the substrate receiving slot 2008. Vapors including solvent vapors are accordingly kept from leaking out, and any such solvent can then be recovered or burned. In order to permit simple threading of the substrate through the frame, one or both sidewalls of the frame can have side slots about 2 to 4 inches high that extend along those sidewalls and are closed as by hinged doors. Through their side slots a person's fingers can be inserted to grip and move the substrate through from entrance slot 2008 to exit slot 2009.

The apparatus of FIG. 27 is also equipped with fire-extinguishing means to prevent the spreading of a fire on the substrate. A substrate such as paper may ignite and start to rapidly burn, as for example, when a side edge tears and pushes itself against the incandescent face of a burner or when a paper substrate moving through the frame 2004 slows down to a speed low enough to permit it to be ignited by the intense irradiation. Such a slow-down is particularly apt to occur when the substrate is a web of printed paper supplied from a high-speed rotary printing press or the like, for quick drying. Problems frequently arise with the press to make slow-down necessary, and it is then much more responsive to operate the fire extinguishing of FIG. 24 rather than pull all the burners away from the paper, as suggested by the prior art.

The fire extinguisher of FIG. 27 is a pair of snuffer bars 2041, 2042 of ceramic fiber or metal held by air cylinders 20 connected to be triggered by a flame detector to push the snuffer bars against opposite faces of the substrate to thus snuff out any fire on the moving or stationary substrate. It may be desirable to locate the snuffing zone well downstream of exit slot 2009 to make sure a detected fire does not get past the snuffing zone before the snuffer is operated.

A similar fire extinguisher can be provided near the substrate entrance slot 2008 to keep fires from travelling upstream on the substrate.

Fire extinguishing action is improved by having jets 2031, 2032 arranged to jet gas at a velocity high enough to blow out most flames, and particularly where the gas so jetted contains little or no oxygen. Such gas can be obtained from the gas withdrawn through the re-radiator panels, particularly where the burners are operated with a combustion mixture at or slightly richer than stoichiometric, and when so-called air-seal burners are used, the air for the air seals is replaced by or diluted with recycled combusted gas.

The burner matrixes are preferably impregnated with about 1% dimethylsilicone water-proofing oil, as described in U.S. Ser. No. 592,793, to make them resistant to the action of streams of water which may reach them when they are not in use and equipment is being hosed down. Also, the matrixes can be made to operate with more uniform incandescence if they are molded from fiber slurries containing at least about 0.2% dispersing agent such as the non-ionic alkylphenylpolyethoxyethanols. The use of a fiber binder such as rubber which cures to a hydrophobic product is also helpful.

Many gases evolved from irradiated substrates are combustible and can be made to burn on surfaces through which they are sucked as at 414 in FIG. 3, to further increase the heating and curing effectiveness of the apparatus of the present invention, and at the same time reduce its environmental impact. A coating of platinum black particles can be applied to the exposed surface of 414, for example, as by spraying it with a solution of chlorplatinic acid and then heating the sprayed surface to a temperature that decomposes the chlorplatinic acid. Catalyst weights of as much as one to two grams per square foot of gross surface (as measured with a ruler) can be used. Other platinum family metals and oxidation catalysts can be substituted for the platinum. Cerium oxide and the oxides of other rare earth metals are examples of good oxidation catalysts.

The gas-fired burners of the present invention can have matrixes of varying sizes and shapes. Although for some purposes radiant faces can be only about 25 centimeters by 25 centimeters in size, the most desirable uses for gas-fired irradiators is in the larger sizes. For spanning movable webs as much as 5 meters wide, it has been previously found desirable to have a long burner with a matrix correspondingly up to about 5 meters long in the cross-machine direction, but only about 30 to 35 centimeters in the machine direction. Making a matrix much larger in the machine direction has not been desirable because the matrix is not sufficiently rigid. Thus, a conventional flat matrix board stiffened only by binders and 2.5 to 3 centimeters thick will, under the pressure of the combustion gases in the mixture plenum, deflect outward by as much as 5 or more millimeters when the matrix length and width are 50 centimeters by 100 centimeters. Such deflection is experienced whether the matrix is in an air-seal burner as in FIGS. 1, 3 and 6, or in a non-air seal burner as in FIG. 12.

The matrixes do not have much tensile or bursting strength, and can be weakened by such bellying out. In addition, the deflection adversely affects the irradiation of substrates that are located only about 3 to 5 centimeters away.

According to the present invention such deflection is securely minimized or completely prevented by the construction of FIGS. 28, 29 and 30. Here, a burner 700 has a burner body 702 to which matrix 704 is clamped by a series of clamping angles 706 secured as by bolts 708 to the burner body.

That body has a shallow sheet metal box 712 to the periphery of which is spot-welded channels 714 that have unequal arms 716, 718 that define an air-seal plenum with a discharge slot 720 extending around the entire periphery of box 712. A trough-shaped stiffener-diffuser 722 is also welded to the box 712 by the same spot welds that secure the peripheral channels 714. A series of apertures 722 in the sides of trough 720 establish passage between the inlet combustion mixture plenum section 726 above the trough, and the outlet combustion mixture plenum section 728 between the trough and the matrix 704.

As more clearly shown in FIGS. 29 and 30, the matrix has its internal surface 730 provided with a groove 732 about 7 to about 10 millimeters deep and about 3 to 4 millimeters wide. A sheet metal strip 734 has one edge inserted in the groove 732 and anchored there with adhesive 736. The strip is preferably about 1.5 millimeters thick, leaving spaces about 1 millimeter wide on each side receiving the adhesive. Through the thickness of strip 734 a series of apertures 738 are provided to provide an adhesive bridge 740 between the adhesive on the opposite sides of the strip. These apertures are preferably about 4 to about 6 millimeters wide and high, and total about 100 square millimeters per decimeter of strip length.

Strip 734 is removably secured to the trough floor 720 as by the snap fastening 744, or the similar fastenings of U.S. Ser. No. 509,161.

As more fully shown in FIG. 29, fastening 744 consists of spring metal rounded latches 746, 748 secured to trough floor 720, that coact with latching apertures 750 in strip 734. Those apertures 750 can be made identical to the bridging apertures 738 so that the strip is symmetrical. After the strip is securely bonded in the matrix, the strip-carrying matrix can then be pushed into place, the free edge of the strip forcing its way between the spring latches, and thus latches itself in place.

The strip can also be pulled out of latching engagement by pulling out the matrix. The latches are arranged to require for disengagement a pulling force substantially greater than the bellying forces developed by the pressure in the combustion mixture plenum. About 25 pounds of disengagement force is adequate for matrixes about 50 centimeters by 100 centimeters. The strip 734 can extend across the entire span of the matrix, or can only be restricted to the center 10 or 15 centimeters of the matrix span.

All of the foregoing dimensions can be varied plus or minus 20% according to the present invention.

The most effective adhesives are elastomeric or rubbery inasmuch as they more securely adhere to the flimsy, flexible fibers of the matrix. Silicone adhesives are preferred because they are not only elastomeric when fully cured, but they are also highly resistant to the heat generated by the burner. Room temperature self-vulcanizing silicone adhesives are very effective, but silicone adhesives that need heat and/or chemical treatment for curing, can also be used. Stainless steels and polished metals might not adhere too well to silicone adhesives, so that it is preferred to make strip 734 of unpolished plain carbon or cold rolled steel. The strip can also be roughened with coarse abrasive.

Groove 732 can be cut into a finished matrix as by means of a circular saw, or it can be molded in as by providing a corresponding insert in a mold in which a slurry of the matrix-forming materials is placed and then molded.

The use of an anchoring strip such as at 734 to help restrain the matrix against bellying out is particularly desirable for matrixes that are both long and wide, as for example, at least about 65 centimeters wide and about 65 centimeters long. The thicker the matrix, the more resistant it is to bellying out but the greater its resistance to gas flow, and thus the greater the bellying force. A matrix as thick as 28 to 32 millimeters but with a flow resistance of 9 centimeters of water column needs less restraint. On the other hand, matrixes having the more usual thicknesses of 22 to 27 millimeters with 9 centimeters of water column resistance can advantageously be provided with restraining strips when they are only about 60 centimeters wide and 60 centimeters long. Matrixes containing powdered silicon carbide, as described in U.S. Pat. No. 4,500,283 are of this type.

The restraining strips are particularly useful when they are also used as plenum partitions as in FIGS. 1, 5 and 6. For such use, the strips are not perforated and can be permanently secured as by welding directly to the back wall of a burner body. To insure a gas-tight mounting against that back wall, the mounting site can be coated with sealer such as silicone cement.

It is helpful to have such restrainer-partition strips penetrate at least about 6 to 8 millimeters into the back of the matrix when they are fitted in a location away from a matrix joint. Shallower penetration in a non-joint location permits significant diffusion of fuel gas through the matrix from one side of the partition to the other, when the plenum compartment on one side of the partition is not supplied with fuel gas. Such diffusion can also be reduced by supplying to the compartment not containing fuel gas, air at a pressure somewhat greater than the pressure in the opposite compartment.

The foregoing restraining strips can be used whether the burner is fitted with an air seal plenum around its edges or whether, as in U.S. Pat. No. 4,416,618, it has no air seal. An air-seal burner can additionally or alternatively have its air seal partition, such as walls 16 and 18 of FIG. 1, increased in height so they penetrate about 6 to 8 millimeters into a groove provided in the underface of matrix 50 and there cemented into place. This reduces changes in the width of the air-seal on the outer surface of the matrix when the pressures in the air-seal and combustion mixture plenums change.

When a burner is not provided with an air seal, the matrix is preferably cemented to the side walls of the burner body and those side walls arranged to conduct away heat fast enough to keep the cement from being significantly damaged by the high temperature of the matrix when it is firing. To this end, the burner body can be an iron or aluminum casting having side walls thicker, preferably at least about 50% thicker than the back wall. Thus, the back wall need only be about 1.5 millimeters thick, but the side walls should be at least about 2.5 millimeters thick when of aluminum, and over 3 millimeters thick when of iron.

By having the matrix project a little beyond the outer lips of the burner's side walls, and covering the thus-exposed projecting side faces of the matrix to prevent or inhibit burning of combustion mixture there, the side walls can be reduced in thickness. This is shown in FIG. 31.

The burner of FIG. 31 has a burner body 101 in the shape of a shallow rectangular open-topped box cast, drawn or fabricated preferably of iron or aluminum, with a floor or back 103 and four side walls 105. Just above floor 103 a cup-shaped baffle 107 is spot-welded to the side walls 105. The welding is between a body side wall and a series of bulges 109 projecting outwardly from side walls 111 on the baffle 107. The baffle can initially be made with perfectly flat side walls, and of such size as to fit within burner body 101 with a relatively small clearance, e.g., 3 to 7 millimeters, between the baffle side walls and the burner body side walls. The bulges are then pressed outwardly from the baffle side walls so as to span the above-mentioned clearance. The thus-completed baffle is now inserted into the burner body and spot-welded as shown at 115, at some or all of the bulges. The floor 113 of the baffle is preferably spaced about 6 to about 12 millimeters above the floor 103 of the burner body.

Perforations as at 112 can be punched through baffle side walls or through the outermost portions of baffle floor 113 to increase the flow of gaseous combustion mixture past the baffle. The mixture is supplied to the plenum chamber 119 below the baffle, from an inlet nipple 121 which can be cast or drawn with the burner body, or welded to the burner floor around an opening punched through it.

A ceramic fiber matrix 123 is fitted snugly into the burner body mouth and preferably rests on the upper edges of the baffle side walls. As in U.S. Pat. No. 4,416,618, the edge faces of matrix 123 are covered with a thin layer 125 of adhesive such as a silicone cement or a polysulfone cement which stands up at temperatures as high as 200° C. to 240° C. The dimensions are arranged so the matrix extends upwardly about 2 to 4 millimeters beyond the top edges of the body side walls.

The body side walls are wrapped with thermal insulation 127 which need only be about 6 to about 10 millimeters thick and held in place as by a sheet metal or expanded metal or metal screen retaining walls 129 having a mounting flange 131 extending under and welded to the body floor 103. The space 133 immediately adjacent the projecting edges of the matrix is preferably filled with strips of high-density fibrous insulation to block or strongly impede the passage of gas from the top edges of the matrix.

When the burner of FIG. 31 is operated, the outer matrix surface is heated to incandescence and the adhesive 125 has its outermost millimeter or two subjected to sufficient heat to damage or destroy its adhesive character. However, the burner still operates very efficiently with little or no flame production beyond the matrix edges, particularly when it is firing face down.

When firing face up the insulation 127 and retaining walls 129 are not needed. However, the fibrous high-density filler in space 133 can be retained and held in place with an encircling strip of metal screening or the like.

The matrix is preferably about 20 to 26 millimeters thick, and the cup-shaped baffle sheet is about 15 to about 20 millimeters deep. Where the insulation 127 is not used, the burner body side walls 105 are preferably about 2 to about 3 millimeters thick when made of iron or cold-rolled 1010 steel, although they can be a little thinner if made of aluminum or if the burner is firing face up and there is no possibility of the burner sides being exposed to high ambient temperatures. Where the insulation 127 is used, the side walls 105 can be about 1.5 millimeters thick.

A tap can be provided for plenum compartment 119 so the pressure of the combustion mixture in it can be monitored.

Gas-fired ceramic-faced burners, whether the ceramic be in fibrous form or in the form of a porous plate, are quite sensitive to the stoichiometry of the combustion mixture burned in them. Small departures either in the rich or lean direction significantly reduce the temperature of the incandescent radiant surface. Any untoward change in the mixture, as for example, by reason of fluctuations in the mixing of air with the fuel gas or in the composition of the fuel gas, or indeed in the moisture content of either the air or the gas, will accordingly change the efficiency with which the burner operates. Prior art developments aimed at overcoming these difficulties have provided control equipment that is too expensive and/or not sufficiently effective.

FIG. 32 shows an improved technique for this purpose. Here, a bank 200 of burners 201, 202 etc. are supplied with combustion mixture through a trunk line 220 leading to individual branches 221, 222, etc. for the individual burners, any or all of which can be turned on and off, and modulated by individual combustion mixture flow control valves 231, 232, etc.

A blower 240 supplies the air for the burners. That air is delivered through conduit 242 and through a mass flow meter 244, to a mixer 246 to which fuel gas is also supplied through conduit 248 having a second mass flow meter 250 and an electrically operated control valve 252. Fuel gas can be delivered to valve 252 from a source of fuel gas under pressure, and a pressure regulator 254 can be used to control the pressure of the fuel gas delivered to valve 252. That pressure can be about ½ to about 5 centimeters of water column greater than the pressure in mixer 246.

The mixture of air and fuel gas formed in mixer 246, which can merely be a T- or Y-pipe connection, is preferably fed to trunk 220 through a homogenizer 256 and a pressure regulator 258. Regulator 258 is preferably adjusted so that the pressure in the combustion mixture trunk line 220 is about that at which a burner operates well. Where the burner is of the felted ceramic fiber type described in connection with FIG. 1 and the felted ceramic mat is about 25 millimeters thick, a suitable combustion mixture pressure in trunk 220 is about 30 centimeters of water column. The mat felting can provide different degrees of porosity and the pressure can be adjusted to provide the desired maximum flow of combustion mixture—generally about 3 cubic meters per minute per square meter of mat surface. Ceramic disk burners and metal mesh burners can be similarly controlled.

To enable the burning of any or all the burners as needed, for example, to operate a profiled paper drier as in FIGS. 16A or 16C of U.S. Pat. No. 4,604,054, using an inexpensive blower 240 that does not have to withstand maximum pressure when all burners are off, the pressure regulator 258 can be connected to operate adjustable splitter 260 which opens and closes the flow of air through a vent conduit 262, inversely to the closing and opening of the flow of air through conduit 242. The regulator can, for example, operate a pressure-responsive diaphragm that carries two needle valves, one connected to open more and more to the vent line 262 as the regulated mixture flow decreases, and the other to close the flow to line 242 as the regulated mixture flow decreases. In such arrangement, the blower will blow all its output air out vent line 262 when all the burners are shut off, and blow essentially all its output air to the burners when all burners are burning.

In line 242 leading the blown air to the mixer 246, there is a mass flow meter 270 which measures the rate of flow of the air to the mixer. That flow rate is coordinated with flow rate of the fuel gas through line 248, to provide mixer 246 with an essentially stoichiometric combustion mixture. Thus, the mass flow meters, which can be of the type shown in U.S. Pat. No. 4,487,062, can provide separate electrical outputs 271 and 272 to a proportion control 274 which has an output 276 that operates fuel gas value 252. The proportion contol is arranged to open or close value 252 so as to make the gas flow in the desired proportion with respect to the air flow to the burners. For certain fuel gases such as propane, the proportion by weight is about 25 parts of air to one part of fuel gas. On the other hand, for fuel gases such as methane or natural gas, the proportion is about 10 parts of air to one part of the fuel gas. A selector switch as shown at 280 can be provided to select the desired proportion. Any logic circuit, such as those of U.S. Pat. No. 4,607,343 and the art of record in that patent, can be used to divide the 271 output by the 272 output, and deliver through line 276 error signals that operate fuel gas adjusting valve 252 to correct the resulting quotient and bring it to the desired proportion. Error correcting arrangements of this type are shown, for example, at pages 369 through 377 of Introduction to Industrial Electronics by R. Ralph Benedict, published 1959 by Prentice-Hall, Inc., Englewood Cliffs, N. J.

The combustion of FIG. 32 thus provides a relatively simple control technique for operating any, all or none of a large group of burners with relatively high efficiency. Where the burners contain air seals as in FIG. 1, a separate take-off 282 can be provided upstream of mass flow meter 270, to direct some of the blown air to those air seals. A control valve in take-off 282 can be used to open the air-seal flow and even to modulate the air-seal flow, if desired. Such modulation can be made automatic by providing an extra proportion control supplied by mass flow meter output 271 and connected to electrically operate the valve in line 282 so as to provide air seal air at the desired proportion to combustion mixture air.

Instead of operating the mixture proportion control from mass flow meters, it can be operated with other devices such as by measuring the infra-red absorption or thermal conductivity of the combustion mixture before or after it is combusted. The fuel gases such as hydrocarbons provide easily measured values before combustion, as well as large carbon dixoide values and other easily measured values such as carbon monoxide and low oxygen, after combustion. Proportional gas-air supplies based on pair of inter-connected floating cone valves, such as those available from Eclipse, Inc., Rockford, Ill., under the designation "Consta-Mix" can also be used, although they need frequent adjusting calibrations. The foregoing techniques do not require the arithmetical dividing operation of control 274.

The control from regulator 258 to the adjustable splitter 260 can be made electrical rather than mechanical, as described. No venting of the air blower is needed, but the venting permits the use of a blower that does not have to be strong enough structurally to withstand the internal pressure of the unvented pressurized air within it when the blower is operating with all burners shut down, for example.

In some cases, a seperate outlet 282 can be used to provide a separate stream of pressurized air, to blow through the air seals of air seal burners, for instance. In such a combination, it is possible to keep the air seal air moving through one or more of the burners even when such burners are not burning, in order to reduce the pressure build-up within the blower when all burners are off and no other burner venting is used.

The control system should have the desired safeguards such as blow-out reliefs in the event of the ignition of the combustion mixture in the trunk and/or burner lines, as well as automatic fuel shut-off when no burner ignition is sensed.

In some cases, as where substrates of varying width are to be irradiated, an assembly of burners or of separately fired burner segments (see U.S. Pat. No. 4,378,207) is arranged in a generally parallel array the total width of which can be as great as 1 to 5 meters. In such an assembly, it can be quite awkward to control the ignition of the burners or burner segments in the interior of the array.

FIG. 33 shows such an array 600, looking at its radiating face 602. That face is divided into a parallel array of five irradiating zones 611, 612, 613, 614, and 615, and also contains a pilot zone 617. Each of these zones can be provided by a separate burner, but they can alternatively be provided by partitioning of one or more large burners, as described in U.S. Pat. No. 4,378,207, or by the use of gas-tight matrix partitions in the manner illustrated in FIGS. 28, 29, and 30 hereinabove. Where such matrix partitions do not extend to the burner face, the array can be connected so that a stream of air is passed through any compartment which is not irradiating but is adjacent one that is irradiating. Such stream will help keep combustion mixture in the irradiating zone from leaking through the matrix to the zone that is not irradiating.

Zones 611 through 615 are elognated in the machine direction represented by arrow 620. That is the direction in which substrates to be irradiated are carried under the zones, as by a conveyor belt or the like. Each of these five zones can be provided by a single burner, or single burner segment, but they can alternatively be provided by a series of two or more shorter burners or burner segments.

The assembly 600 can be used for drying the output of printing machines, or as a pre-drier in a textile processing operation, or for profile drying of paper as it is manufactured in a paper-making machine, or for any other variable width irradiation. When the substrate, such as printed papers, are only approximately as wide as zone 615, then the assembly 600 is arranged so those papers are carried only through that zone, the remaining parallel zones being then turned off. When the printed papers are wider than zone 613, then 612 and/or 614 can be fired along with zone 613, and for the widest substrates all five parallel zones can be fired, and thus any width can be used without having to change the structure of the assembly.

Zone 613 is arranged to be ignited by the operation of pilot zone 617, which in turn is ignited by igniter 630 which can be a gas flame supply or an electric sparking unit. Igniter 630 is mounted at a side edge of assembly 600, so that it is conveniently positioned and can be readily maintained without having to reach into the interior. The combustion of the combustion mixture at the face of the pilot zone will readily ignite combustion mixture emerging from zone 613, even when these two zones are separated by air seals totalling several inches in width. This is particularly true when the burner assembly is operated facing downward.

Pilot zone 617 is shown as extending to zone 612, so that zone 612 can be readily ignited when zone 613 is not in operation. If desired, the pilot zone can be similarly extended to zone 611. Where no unilateral operation of zone 612 or 611 is needed, the pilot zone can be shortened since it need not traverse the full width of zone 613. In the machine direction the pilot zone need only be about 2 to about 5 centimeters wide. It can be kept firing whenever substrates are being irradiated, and can be arranged so it turns down to a minimum firing condition but does not turn off when substrate irradiation is interrupted.

FIG. 34 shows an igniter sub-assembly 630 which is particularly desirable. Here, a metal mounting channel 632 is fitted with a block of thermal insulation 634 held in place as by washer 636 clamped by rivet 638 against the web of the channel.

Welded through an opening in the channel web is a flame tube 640 having a combustion mixture inlet 642 and inlet nozzle 644 at one end. Adjacent that nozzle the electrodes 646 of a spark plug 648 are fitted to ignite the incoming combustion mixture.

The other end of the flame tube has one side partially cut away to provide a side window 650 for receiving the end 652 of a flame rod 654 held there by a suitable mounting within a ceramic tube 656. Tube 656 is clamped in a fitting welded through a separate opening in channel 632, and an electrical connector 658 is fitted onto the outer end of the flame rod.

By having the flame rod end 652 within about one centimeter from this wall of the flame tube and arranged so that about 3 to 6 millimeters of the rod end 652 is rendered incandescent by the burning combustion mixture, very dependable flame sensing is obtained. The flame rod end should be about 2 to 3 millimeters thick.

The thermal insulation 634 also improves the operation by helping keep the outer metal portions from getting too hot. Mounting the sub-assembly 630 as by screws to a sheet metal extension on the frame of a burner with the insulation 634 between that extension and the sub-assembly is all that is needed. The thickness of the insulation can be from about 4 to about 15 millimeters. Spark plug 648 can be tilted so as not to excessively obstruct access to the rivet and to mounting screws.

Obviously, many modifications and variations of the present invention are possible in light of the above teachings. It is, therefore, to be understood that within the scope of the appended claims the invention may be practiced otherwise than as specifically described.

I claim:

1. In an infra-red generator having a ceramic fiber mat covering a principal combustion mixture plenum from which a combustion mixture is passed through the thickness of the mat to emerge from a surface on which the mixture burns to heat to incandescence the fibers on that surface, the improvement according to which the combustion mixture plenum has a partition vane extending adjacent one of its edges to form a small pilot combustion compartment isolated from the principal plenum, said compartment having its own combustion mixture supply inlet separate from that for the principal plenum, the supply inlet being connected as a pilot supply and igniting means fitted adjacent the outer surface of the mat over the pilot compartment to ignite the combustion mixture emerging from that compartment.

2. In an infra-red generator having a ceramic fiber mat covering a combustion mixture plenum from which a combustion mixture is passed through the thickness of the mat to emerge from a surface on which the mixture burns to heat to incandescence to fibers on that surface, the improvement according to which the combustion mixture plenum has a pilot compartment of about 100 cubic centimeters volume partitioned from the remainder of the plenum and opening against the mat, said pilot compartment having its own combustion mixture supply separate from that for the remainder of the plenum, and connected to act as a combustion pilot for the burning.

3. A longitudinally extending gas-fired infra-red generator having a substantial firing face divided into a longitudinally-extending isolated intermediate section confined on both sides by longitudinally-extending lateral sections that selectively increase the transverse firing width, and a narrow pilot combustion zone that extends transversely essentially from the intermediate section to the transverse edge of the generator, said pilot zone having it own fuel supply to effect ignition of the intermediate section from that edge.

4. The combination of claim 3 in which the pilot burner is located sufficiently close to at least some of the lateral firing zones to also ignite such lateral zones when they are supplied with combustion mixture.

5. The combination of claim 3 in which at least some of the burners have air seals and the pilot burner contacts the burners it is to ignite inboard of those seals.

6. The combination of claim 3 in which the pilot zone is sufficiently narrow that it can be kept fired regardless of the other sections.

* * * * *